US011468865B2

(12) United States Patent
Kang

(10) Patent No.: US 11,468,865 B2
(45) Date of Patent: Oct. 11, 2022

(54) DISPLAY PANEL FOR DISPLAYING HIGH-LUMINANCE AND HIGH-COLOR SATURATION IMAGE, AND IMAGE DISPLAY APPARATUS INCLUDING THE SAME

(71) Applicant: LG ELECTRONICS INC., Seoul (KR)

(72) Inventor: Kyungjin Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 215 days.

(21) Appl. No.: 16/512,035

(22) Filed: Jul. 15, 2019

(65) Prior Publication Data

US 2020/0082786 A1 Mar. 12, 2020

Related U.S. Application Data

(60) Provisional application No. 62/697,764, filed on Jul. 13, 2018.

(30) Foreign Application Priority Data

Oct. 5, 2018 (KR) ..... 10-2018-0118934

(51) Int. Cl.
*G09G 5/02* (2006.01)
*G09G 5/10* (2006.01)
(Continued)

(52) U.S. Cl.
CPC ..... *G09G 5/02* (2013.01); *G09G 3/3225* (2013.01); *G09G 3/3607* (2013.01);
(Continued)

(58) Field of Classification Search
CPC .. G09G 3/2003; G09G 3/2007; G09G 3/2074; G09G 3/30; G09G 3/32;
(Continued)

(56) References Cited

U.S. PATENT DOCUMENTS

2011/0080442 A1* 4/2011 Ghosh ..... G09G 3/2003 345/694
2012/0242719 A1* 9/2012 Klompenhouwer ..... G09G 3/2074 345/690

(Continued)

OTHER PUBLICATIONS

European Patent Office Application Serial No. 19186261.4, Search Report dated Feb. 13, 2020, 18 pages.

*Primary Examiner* — Keith L Crawley
(74) *Attorney, Agent, or Firm* — Lee, Hong, Degerman, Kang & Waimey PC

(57) ABSTRACT

Disclosed is an image display apparatus including a display panel having a plurality of pixels, and a controller configured to control the display panel, wherein the plurality of pixels includes luminance pixels including subpixels of multiple colors and color pixels including subpixels of multiple colors, and wherein the luminance pixels output light with luminance higher than luminance of the color pixels and the color pixels output light with color purity higher than color purity of the luminance pixels. Accordingly, a high luminance and high color-saturation image may be displayed with the image display apparatus including the luminance pixels and the color pixels.

17 Claims, 34 Drawing Sheets

(51) Int. Cl.
*G09G 3/36* (2006.01)
*G09G 3/3225* (2016.01)

(52) U.S. Cl.
CPC ..... *G09G 3/3648* (2013.01); *G09G 5/10* (2013.01); *G09G 2300/0452* (2013.01); *G09G 2320/0233* (2013.01); *G09G 2320/0666* (2013.01); *G09G 2340/0457* (2013.01); *G09G 2340/06* (2013.01)

(58) Field of Classification Search
CPC ..... G09G 3/3208; G09G 3/3225; G09G 3/36; G09G 3/3607; G09G 3/3648; G09G 5/005; G09G 5/02; G09G 5/10; G09G 2300/0452; G09G 2320/0233; G09G 2320/0242; G09G 2320/0271; G09G 2320/0626; G09G 2320/0666; G09G 2340/0457; G09G 2340/06
See application file for complete search history.

(56) References Cited

U.S. PATENT DOCUMENTS

| | | | | |
|---|---|---|---|---|
| 2013/0342587 | A1* | 12/2013 | Nakagawa ..... | G09G 3/3208 345/690 |
| 2016/0027404 | A1* | 1/2016 | Nakanishi ..... | G09G 3/2074 345/590 |
| 2016/0163249 | A1 | 6/2016 | Yata et al. | |
| 2016/0260401 | A1* | 9/2016 | Sakaigawa ..... | G09G 3/3607 |
| 2017/0352304 | A1 | 12/2017 | Funatsu | |
| 2018/0040284 | A1 | 2/2018 | Kang | |

* cited by examiner

FIG. 13A

| Primary color | high-saturation color pixel (BT.2020) | | | high-saturation color pixel +high luminance pixel (BT.709) | | | high luminance pixel | | |
|---|---|---|---|---|---|---|---|---|---|
| | X | Y | Z | X | Y | Z | X | Y | Z |
| R | 63.70 | 26.27 | 0.00 | 41.24 | 21.26 | 1.93 | 18.78 | 16.26 | 3.86 |
| G | 14.46 | 67.80 | 2.81 | 35.76 | 71.52 | 11.92 | 57.06 | 75.23 | 21.03 |
| B | 16.89 | 5.93 | 106.10 | 18.05 | 7.22 | 95.05 | 19.21 | 8.51 | 84.00 |
| White (D65) | 95.05 | 100.00 | 108.91 | 95.05 | 100.00 | 108.91 | 95.05 | 100.00 | 108.91 |

FIG.22B

| APL(%) | EXAMPLE OF WRGB OLED LUMINANCE(cd/m$^2$) | EXAMPLE OF DUAL GAMUT LUMINANCE(cd/m$^2$) | LUMINANCE INCREASE RATE |
|---|---|---|---|
| 10(Peak) | 800 | 800 | EQUAL |
| 20 | 600 | 800 | 33% ↑ |
| 25 | 500 | 750 | 50% ↑ |
| 50 | 280 | 500 | 79% ↑ |
| 100 | 150 | 280 | 87% ↑ |

DISPLAY PANEL FOR DISPLAYING HIGH-LUMINANCE AND HIGH-COLOR SATURATION IMAGE, AND IMAGE DISPLAY APPARATUS INCLUDING THE SAME

CROSS-REFERENCE TO RELATED APPLICATION

Pursuant to 35 U.S.C. § 119, this application claims the benefit of earlier filing date and right of priority to Korean Application No. 10-2018-0118934, filed on Oct. 5, 2018, and also claims the benefit of U.S. Provisional Application No. 62/697,764, filed on Jul. 13, 2018, the contents of which are all hereby incorporated by reference herein in their entirety.

BACKGROUND OF THE INVENTION

1. Field of the Invention

The present invention relates to a display panel and an image display apparatus including the same, and more particularly to a display panel capable of displaying a high luminance and high color-saturation image in an image display apparatus including luminance pixels and color pixels, and the image display apparatus including the display panel.

2. Description of the Related Art

A display panel is a panel for displaying an image and primarily used in an image display apparatus.

Meanwhile, the display panel may be in any of various structures such as a structure including RGB subpixels and a structure including RGBW subpixels. Research on methods for displaying a high resolution image according to each of the structures are ongoing.

In addition, various methods for displaying a high luminance and high color-saturation image in addition to the high resolution image are also under development.

SUMMARY OF THE INVENTION

Embodiments of the present invention provide a display panel capable of displaying a high luminance and high color-saturation image in an image display apparatus including luminance pixels and color pixels, and the image display apparatus including the same.

Embodiments of the present invention provide a display panel capable of displaying a high resolution image, and an image display apparatus including the same.

In accordance with an embodiment of the present invention, the above and other objects can be accomplished by the provision of an image display apparatus including: a display panel comprising a plurality of pixels; and a controller configured to control the display panel, wherein the plurality of pixels comprises luminance pixels including subpixels of multiple colors and color pixels including subpixels of multiple colors, and wherein the luminance pixels output light with luminance higher than luminance of the color pixels and the color pixels output light with color purity higher than color purity of the luminance pixels.

The controller may be configured to: separate an input image into luminance pixel data for displaying the image via the luminance pixels and color pixel data for displaying the image via the color pixels; and output at least one of the luminance pixel data or the color pixel data.

The controller may be configured to: change luminance of the luminance pixel data or luminance of the color pixel data to be different from luminance of the input image; and change a color gamut of the luminance pixel data or a color gamut of the color pixel data to be different from a color gamut of the input image.

The controller may be configured to set a luminance variable gain for the luminance pixel data and a luminance variable gain for the color pixel data to be different from each other.

The display panel may include an organic light emitting panel, and the controller may be configured to: calculate an Average Picture Level (APL) of the input image; and convert a luminance level of the input image into a set luminance level based on the calculated APL, and output at least one of the luminance pixel data or the color pixel data based on the converted luminance level.

The controller may be configured to output only the luminance pixel data based on color saturation of an area in the input image being less than or equal to a first color saturation threshold.

The controller may be configured to output both the luminance pixel data and the color pixel data based on the color saturation of the area in the input image being higher than the first color saturation threshold.

The controller may be configured to output the luminance pixel data and the color pixel data at any area other than an achromatic area of the input image.

The luminance pixels and the color pixels may be arranged in a checkerboard pattern, and the controller may be configured to control the display panel to display the input image comprising a grill pattern image having a black area without performing a subpixel rendering operation of transferring luminance data to an adjacent color pixel or an adjacent luminance pixel with respect to the black area.

The luminance pixels and the color pixels may be arranged in a checkerboard pattern, and the controller may be configured to control the display panel to display the input image comprising a grill pattern image having a black area based on a variable color gamut.

The display panel may include a liquid crystal panel, and the controller may be configured to perform a subpixel rendering operation with respect to the input image of transferring luminance data to an adjacent color pixel or an adjacent luminance pixel.

The controller may be configured to control the display panel to display a portion of color pixel data in an adjacent luminance pixel and a portion of luminance pixel data in an adjacent color pixel according to the subpixel rendering operation.

The controller may be configured to control the display panel to display the input image comprising a grill pattern image having a black area without performing a subpixel rendering operation of transferring luminance data to an adjacent color pixel or an adjacent luminance pixel with respect to the black area.

The multiple colors of the luminance pixels and the multiple colors of the color pixels may be identical.

The luminance pixels may include subpixels of red (R), green (G), and blue (B) colors, and the color pixels may include subpixels of R, G, B colors.

The multiple colors of the luminance pixels and the multiple colors of the color pixels may be different.

The luminance pixels may include subpixels of cyan (C), magenta (M), and yellow (Y) colors, and the color pixels may include subpixels of R, G, B colors.

In accordance with another embodiment of the present invention, the above and other objects can be accomplished by the provision of a display panel including: luminance pixels including subpixels of multiple colors; color pixels including subpixels of multiple colors, wherein the luminance pixels output light with luminance higher than luminance of the color pixels, and wherein the color pixels output light with color purity higher than color purity of the luminance pixels.

The display panel may further include: a first color filter disposed above the subpixels of the multiple colors of the luminance pixels; and a second color filter disposed above the subpixels of the multiple colors of the color pixels, wherein a wavelength of light transmitted through the first color filter is greater than a wavelength of light transmitted through the second color filter, and wherein a light transmittance of the second color filter is greater than a light transmittance of the first color filter.

The luminance pixels may include subpixels of red (R), green (G), and blue (B) colors, and the color pixels may include subpixels of R, G, and B colors.

The color pixels may have a color gamut wider than a color gamut of the luminance pixels.

The luminance pixels and the color pixels may be arranged in a checkerboard pattern.

The image display apparatus according to an embodiment of the present invention includes: a display panel comprising luminance pixels including subpixels of multiple colors, and color pixels including subpixels of multiple colors, wherein the luminance pixels output light with luminance higher than luminance of the color pixels, and the color pixels output light with color purity higher than color purity of the luminance pixels; and a controller configured to control the display panel. Accordingly, a high luminance and high color-saturation image may be displayed with the image display apparatus including the luminance pixels and the color saturation pixels. In addition, a high resolution image may be displayed.

The controller may be configured to: separate an input image into luminance pixel data for displaying the image via the luminance pixels and color pixel data for displaying the image via the color pixels; and output at least one of the luminance pixel data or the color pixel data. Accordingly, a high luminance and high color-saturation image may be displayed.

The controller may be configured to: change luminance of the luminance pixel data or luminance of the color pixel data to be different from luminance of the input image; and change a color gamut of the luminance pixel data or a color gamut of the color pixel data to be different from a color gamut of the input image. Accordingly, a high luminance and high color-saturation image may be displayed.

The controller may be configured to set a luminance variable gain for the luminance pixel data and a luminance variable gain for the color pixel data to be different from each other. Accordingly, a high luminance image may be displayed.

The display panel may include an organic light emitting panel, and the controller may be configured to: calculate an Average Picture Level (APL) of the input image; and convert a luminance level of the input image into a set luminance level based on the calculated APL, and output at least one of the luminance pixel data or the color pixel data based on the converted luminance level. Accordingly, a high luminance and high color-saturation image may be displayed while a driving operation with low power consumption is performed according to the APL.

The controller may be configured to, when color saturation of an area in the input image is equal to or lower than a first color saturation threshold, output only the luminance pixel data. Accordingly, a high luminance image may be displayed.

The controller may be configured to, when the color saturation of the area in the input image is higher than the first color saturation threshold, output both the luminance pixel data and the color pixel data. Accordingly, a high luminance and high color-saturation image may be displayed.

The controller may be configured to output the luminance pixel data and the color pixel data with respect to any area other than an achromatic area in the input image. Accordingly, a high luminance and high color-saturation image may be displayed.

The luminance pixels and the color pixels may be arranged in a checkerboard pattern, and the controller may be configured to, when the input image is a grill pattern image including a black area, display the grill pattern image without performing a subpixel rendering operation of transferring luminance data to an adjacent color pixel or an adjacent luminance pixel with respect to the black area.

The luminance pixels and the color pixels may be arranged in a checkerboard pattern, and the controller may be configured to, when the input image is a grill pattern image including a black area, display the grill pattern image based on a variable color gamut. Accordingly, the grill pattern image may be displayed with sharpness.

The display panel may include a liquid crystal panel, and the controller may be configured to perform a subpixel rendering operation of transferring luminance data to an adjacent color pixel or an adjacent luminance pixel with respect to an input image. Accordingly, a high luminance and high color-saturation image may be displayed.

The controller may be configured to, according to the subpixel rendering operation, display a portion of color pixel data in an adjacent luminance pixel, and a portion of luminance pixel data in an adjacent color pixel.

The controller may be configured to, when the input image is a grill pattern image including a black area, display the grill pattern image without performing a subpixel rendering operation of transferring luminance data to an adjacent color pixel or an adjacent luminance pixel with respect to the black area. Accordingly, the grill pattern image may be displayed with sharpness.

The display panel according to an embodiment of the present invention includes: luminance pixels including subpixels of multiple colors; color pixels including subpixels of multiple colors, wherein the luminance pixels output light with luminance higher than luminance of the color pixels, and wherein the color pixels output light with color purity higher than color purity of the luminance pixels. Accordingly, a high luminance and high color saturation image may be displayed. In addition, a high resolution image may be displayed.

The display panel may further include: a first color filter disposed above the subpixels of the multiple colors of the luminance pixels; and a second color filter disposed above the subpixels of the multiple colors of the color pixels, wherein a wavelength width of light transmitted through the first color filter is greater than a wavelength width of light transmitted through the second color filter, and wherein a light transmittance of the second color filter is greater than a light transmittance of the first color filter. Accordingly, a high luminance and high color saturation image may be displayed.

The luminance pixels and the color pixels may be arranged in a checkerboard pattern. Accordingly, a high luminance and high color saturation image may be displayed.

BRIEF DESCRIPTION OF THE DRAWINGS

FIGS. 13A and 13B are diagrams for explanation of operations illustrated in FIG. 12.

DETAILED DESCRIPTION

Hereinafter, embodiments of the present invention will be described in more detail with reference to the accompanying drawings.

Figure 1:
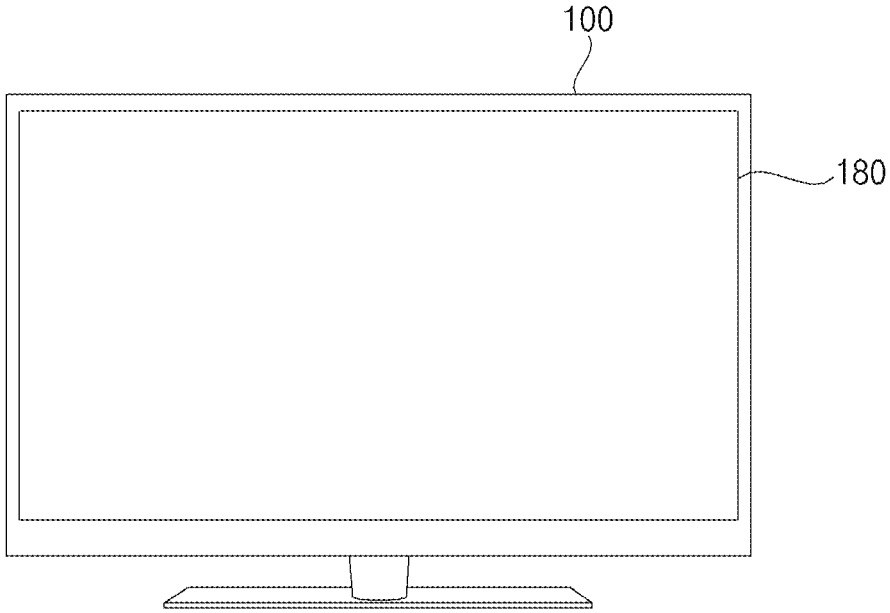
FIG. 1 is a diagram illustrating an image display apparatus according to an embodiment of the present invention.

As used herein, the suffixes "module" and "unit" are added to simply facilitate preparation of this specification and are not intended to suggest special meanings or functions. Therefore, the suffixes "module" and "unit" may be used interchangeably. FIG. 1 is a diagram illustrating an image display apparatus according to an embodiment of the present invention.

Referring to FIG. 1, an image display apparatus 100 according to an embodiment of the present invention may include a display module 180 and a controller 170 (see FIG. 2) for displaying an image on the display module 180.

Various techniques for improving sharpness in image display have been researched in the trend of increasing the resolution of the image display apparatus 100 to HD (High Definition), Full HD, UHD (Ultra High Definition) and the like.

As the resolution of the display module 180 becomes higher, panels including RGBW pixels are used in addition to panels including RGB pixels.

Accordingly, embodiments of the present invention provides an image display apparatus including luminance pixels and color pixels and which is capable of displaying a high luminance and high color-saturation image.

An image display apparatus 100 according to an embodiment of the present invention includes: a display panel 210 comprising luminance pixels pixelL including subpixels of multiple colors and color pixels pixelC including subpixels of multiple colors, wherein the luminance pixels pixelL output light with luminance higher than luminance of the color pixels pixelC, and the color pixels pixelC have color purity higher than color purity of the luminance pixels pixelL; and a controller 170 or 232 for controlling the display panel 210. Accordingly, in the image display apparatus including the luminance pixels pixelL and the color pixels pixelC, a high luminance and high color-saturation image may be displayed. In addition, a high resolution image may be displayed.

The controller 170 or 232 may divide an input image into luminance pixel data for displaying the image via the luminance pixels pixelL and color pixel data for displaying the image via the color pixels pixelC, and output at least one of the luminance pixel data or the color pixel data. Accordingly, a high luminance and high color-saturation image may be displayed.

The controller 170 or 232 may change luminance of the luminance pixel data or luminance of the color pixel data to be different from luminance of the input image, and may change a color gamut of the luminance pixel data or a color gamut of the color pixel data to be different from a color gamut of the input image. Accordingly, a high luminance and high color-saturation image may be displayed.

The controller 170 or 232 may set a luminance variable gain for the luminance pixel data and a luminance variable gain for the color pixel data to be different from each other. Accordingly, a high luminance image may be displayed.

A technique of displaying a high luminance and high color-saturation image with the above-described image display apparatus will be described in more detail with reference to FIG. 5A and subsequent drawings.

Figure 2:
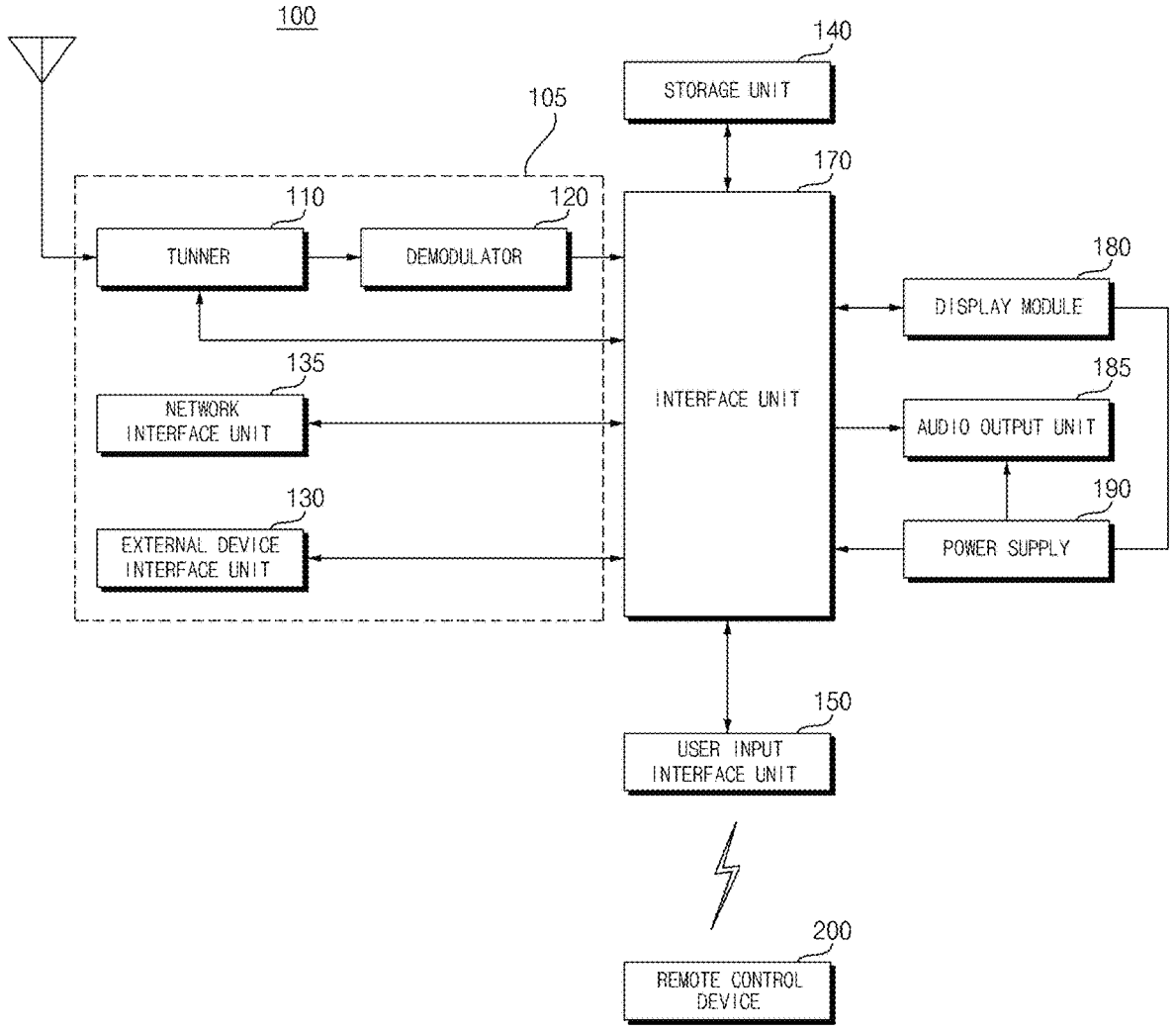
FIG. 2 is a block diagram illustrating an image display apparatus according to an embodiment of the present invention.

FIG. 2 is a block diagram illustrating an image display apparatus according to an embodiment of the present invention.

Referring to FIG. 2, the image display apparatus 100 according to an embodiment may include a broadcast receiver 105, an external device interface unit 130, a storage unit 140, a user input interface unit 150, a sensor unit (not shown), a controller 170, a display module 180, and an audio output unit 185.

The broadcast receiver 105 may include a tuner 110, a demodulator 120, and a network interface unit 130. Of course, the broadcast receiver may be designed to include the tuner unit 110 and the demodulator unit 120 but not the network interface unit 130, if necessary. Alternatively, the broadcast receiver may be designed to include the network interface unit 130 but not include the tuner unit 110 and the demodulator unit 120.

Unlike the example of the figure, the broadcast receiver 105 may include an external device interface unit 130 (see FIG. 2). For example, a broadcast signal from the set-top box 250 of FIG. 1 can be received through the external device interface unit 130 (see FIG. 2).

The tuner 110 selects a radio frequency (RF) broadcast signal corresponding to a channel selected by a user or all pre-stored channels from among the RF broadcast signals received through an antenna 50. In addition, the tuner 110 converts the selected RF broadcast signal into an intermediate frequency signal, a base band image, or a voice signal.

For example, if the selected RF broadcast signal is a digital broadcast signal, the signal is converted into a digital input format (IF) (DIF) signal. If the selected RF broadcast signal is an analog broadcast signal, the signal is converted into a baseband image or a voice signal such as a composite video baseband signal and/or source input format signal (CVBS/SIF). That is, the tuner 110 may process a digital broadcast signal or an analog broadcast signal. The analog baseband image or voice signal (CVBS/SIF) output from the tuner 110 may be directly input to the controller 170.

In this embodiment, the tuner 110 may sequentially select an RF broadcast signal for all stored broadcast channels from among RF broadcast signals received through the antenna through the channel memorization function, and convert the same into an intermediate-frequency signal, baseband image, or voice signal.

To receive broadcast signals of a plurality of channels, a plurality of tuners 110 may be provided. Alternatively, a single tuner to receive a plurality of channels simultaneously may be provided.

The demodulator 120 receives the digital IF signal DIF converted by the tuner 110 and performs a demodulation operation.

After performing demodulation and channel decoding, the demodulator 120 may output a stream signal TS. Herein, the stream signal may be a signal obtained by multiplexing an image signal, audio signal, or data signal.

The stream signal output from the demodulator 120 may be input to the controller 170. After performing demultiplexing and image/audio signal processing, the controller 170 outputs an image to the display module 180 and audio to the audio output unit 185.

The external device interface unit 130 may transmit or receive data to or from a connected external device 190. To this end, the external device interface unit 130 may include an A/V input/output unit (not shown) or a wireless communication unit. The external device interface unit 130 may be connected to external devices such as a DVD (digital versatile disk) device, a Blu-ray device, a gaming device, a camera, a camcorder, a computer such as a laptop, or a set-top box in a wired/wireless manner, and perform input/output operations with the external devices.

The A/V input/output unit may receive image and audio signals input from an external device. Meanwhile, the wireless communication unit may perform short-range wireless communication with other electronic devices.

The network interface unit 135 provides an interface for connection with a wired/wireless network, such as the Internet. For example, the network interface unit 135 may receive content or data provided by a content provider or a network operator over a network.

The storage unit 140 may store programs for processing and control of signals in the controller 170, and also store a signal-processed image, audio signals, or data signals.

The storage unit 140 may also function to store an image signal, an audio signal, or a data signal input through the external device interface unit 130. In addition, the storage unit 140 may store information about a predetermined broadcast channel through the channel memorization function such as a channel map.

While it is illustrated in FIG. 2 that the storage unit 140 is provided separately from the controller 170, embodiments of the present invention are not limited thereto. The storage unit 140 may be provided in the controller 170.

The user input interface unit 150 may transmit a signal input by the user to the controller 170 or output information corresponding to a signal from the controller 170 to the user.

For example, the user input interface unit 150 may transmit/receive user input signals such as power on/off, channel selection, and screen window setting to/from the remote control device 200; deliver, to the controller 170, user input signals input through local keys (not shown) such as a power key, a channel key, a volume key, or a setting key; deliver, to the controller 170, user input signals input through a sensor unit (not shown) configured to sense gesture of the user; or transmit a signal from the controller 170 to the sensor unit (not shown).

The control unit 170 may demultiplex the input stream or process the demultiplexed signals through the tuner unit 110, the demodulator 120, or the external device interface unit 130 to generate and output a signal for outputting an image or sound.

An image signal image-processed by the controller 170 may be input to the display module 180 and an image corresponding to the image signal may be displayed. In addition, the image signal which is image-processed by the controller 170 may be input to an external output device through the external device interface unit 130.

An audio signal processed by the controller 170 may be output to the audio output unit 185. In addition, the audio signal processed by the controller 170 may be input to an external output device through the external device interface unit 130.

Although not shown in FIG. 2, the controller 170 may include a demultiplexer and an image processor, which will be described with reference to FIG. 3.

Additionally, the controller 170 may control overall operation of the image display apparatus 100. For example, the controller 170 may control the tuner 110 to tune in RF broadcasting corresponding to a channel selected by the user or a pre-stored channel.

The controller 170 may control the image display apparatus 100 according to a user command input through the user input interface unit 150 or an internal program.

The controller 170 may control the display module 180 to display an image. Herein, the image displayed on the display module 180 may be a still image, a moving image, a 2D image, or a 3D image.

The controller 170 may create and display a 3D object representation of a predetermined 2D object in an image on the display module 180. For example, the object may be at least one of an accessed web page (a newspaper, a magazine, etc.), an EPG (electronic program guide), various menus, a widget, an icon, a still image, a moving image, or a text.

The 3D object may be processed to have a depth different from that of other images displayed on the display module 180. Preferably, the 3D object may be processed to appear three-dimensional compared to the other images displayed on the display module 180.

The controller 170 may recognize the position of the user based on the image captured by an image capture unit (not shown), such as a camera or infrared camera. For example, the distance (referred to as a z-axis coordinate value) between the user and the image display apparatus 100 may be identified. The X coordinate (side-to-side) and the Y coordinate (up-and-down) corresponding to the user position with respect to the display module 180 may also be identified.

Although not shown in the figures, a channel browsing processor for creating a thumbnail image corresponding to a channel signal or an external input signal may be further provided. The channel browsing processor may receive a stream signal TS output from the demodulator 120 or a stream signal output from the external device interface unit 130 and extract an image from the input stream signal to create a thumbnail image. The created thumbnail image may be stream-decoded together with a decoded image and input to the controller 170. The controller 170 may display a thumbnail list including a plurality of thumbnail images on the display module 180 using the input thumbnail image.

The thumbnail list may be displayed in a simple view mode in which the thumbnail list is displayed on a part of the display module 180 with a predetermined image displayed on the display module 180, or may be displayed in a full view mode in which the thumbnail list is displayed in most of the area of the display module 180. The thumbnail images in the thumbnail list may be sequentially updated.

The display module 180 generates drive signals by converting an image signal, data signal, on-screen display (OSD) signal, and control signal processed by the controller 170 or an image signal, data signal, and control signal received from the external device interface unit 130.

The display module 180 may be a plasma display panel (PDP), a liquid crystal display (LCD), organic light emitting diode (OLED) display, a flexible display, or a 3D display module.

The display module 180 may be configured as a touch-screen and used not only as an output device but also as an input device.

The audio output unit 185 receives an audio signal processed by the controller 170 and outputs audio.

The capture unit (not shown) captures an image of the user. The capture unit (not shown) may be implemented using one camera. However, embodiments of the present invention are not limited thereto. The capture unit (not shown) may be implemented using a plurality of cameras. The capture unit (not shown) may be located in the upper portion of the display module 180 of the image display apparatus or may be separately disposed. Image information captured by the capture unit (not shown) may be input to the controller 170.

The controller 170 may sense a gesture of the user based on an image captured by the capture unit (not shown), a sensed signal from the sensor unit (not shown), or a combination thereof.

The power supply 190 supplies power to the image display apparatus 100 and its components. In particular, the power supply 190 may supply power to the controller 170, which may be implemented in the form of a system on chip (SOC), the display module 180 for display of images, and the audio output unit 185 for outputting audio signals.

Specifically, the power supply 190 may include a converter to convert alternating current (AC) power into direct current (DC) power and a DC-DC converter to change the level of the DC power.

The remote control device 200 transmits a user input to the user input interface unit 150. To this end, the remote control device 200 may employ BLUETOOTH, radio frequency (RF) communication, infrared (IR) communication, ultra-wideband (UWB), or ZigBee. In addition, the remote control device 200 may receive an image signal, an audio signal, or a data signal from the user input interface unit 150, and display or output the same.

The image display apparatus 100 may be a fixed or mobile digital broadcast receiver capable of receiving digital broadcast services.

The block diagram of the image display apparatus 100 shown in FIG. 2 is simply illustrative. Constituents of the block diagram may be integrated, added or omitted according to the specification of the image display apparatus 100. That is, two or more constituents may be combined into one constituent, or one constituent may be subdivided into two or more constituents. In addition, it will be understood by those of ordinary skill in the art that the function performed in each block is simply illustrative, and it should be noted that specific operations or devices of the blocks do not limit the scope of the embodiments of the present invention.

Unlike the example shown in FIG. 2, the video display apparatus 100 may not include the tuner unit 110 and the demodulator 120 shown in FIG. 2, but may receive and reproduce image content through the network interface unit 135 or an external device interface unit 130.

The image display apparatus 100 is an example of an image signal processing apparatus that performs signal processing of an image stored in the apparatus or an input image. Other examples of the image signal processing apparatus may include a set-top box, A DVD player, a Blu-ray player, a gaming device, or a computer.

Figure 3:
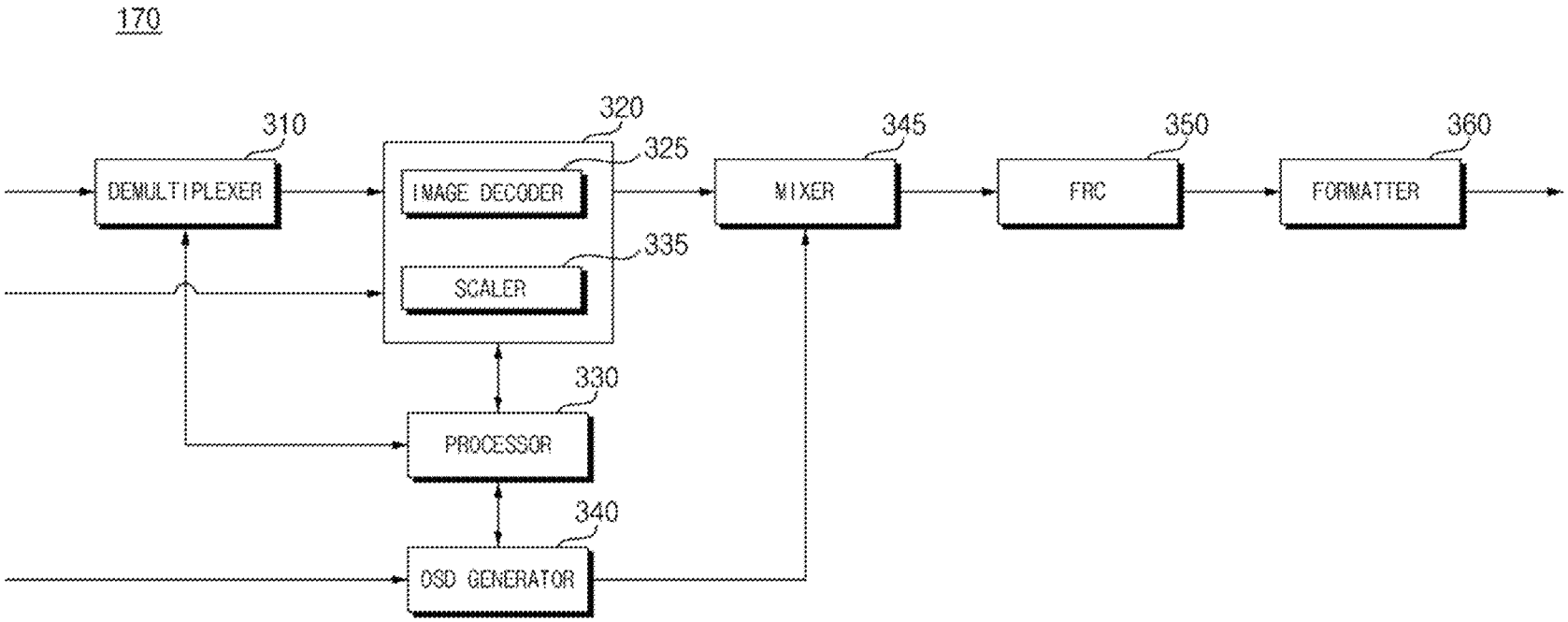
FIG. 3 is a block diagram illustrating the controller of FIG. 2.

FIG. 3 is a block diagram illustrating the controller of FIG. 2.

Referring to FIG. 3, the controller 170 according to an embodiment of the present invention may include a demultiplexer 310, an image processor 320, a processor 330, an OSD generator 340, a mixer 345, a frame rate converter 350, and a formatter 360. The controller 170 may further include an audio processor (not shown) and a data processor (not shown).

The demultiplexer 310 demultiplexes an input stream. For example, when an MPEG-2 TS is input, the demultiplexer 310 may demultiplex the same to separate the stream into an image signal, an audio signal, and a data signal. Herein, the stream signal input to the demultiplexer 310 may be a stream signal output from the tuner 110, the demodulator 120, or the external device interface unit 130.

The image processor 320 may perform image processing on the demultiplexed image signal. To this end, the image processor 320 may include an image decoder 325 and a scaler 335.

The image decoder 325 decodes the demultiplexed image signal, and the scaler 335 scales the resolution of the decoded image signal such that the image signal can be output through the display module 180.

The image decoder 325 may include decoders of various standards.

The image signal decoded by the image processor 320 may have only a 2D image signal, a combination of a 2D image signal and a 3D image signal, or only a 3D image signal.

For example, an external image signal input from an external device or a broadcast image signal in a broadcast signal received from the tuner 110 may have only a 2D image signal, a combination of a 2D image signal and a 3D image signal, or only a 3D image signal. Accordingly, the external image signal or the broadcast signal may be processed by the controller 170, particularly, the image processor 320 to output the 2D image signal, the combination of the 2D image signal and the 3D image signal, or the 3D image signal.

The image signals decoded by the image processor 320 may be 3D image signals of various formats. For example, the 3D image signal may include a color image and a depth image, or include a multi-view point image signals. The multi-view point image signal may include, for example, a left-eye image signal and a right-eye image signal.

The processor 330 may control overall operation of the image display apparatus 100 or the controller 170. For example, the processor 330 may control the tuner 110 to tune in RF broadcasting corresponding to a channel selected by the user or a pre-stored channel.

In addition, the processor 330 may control the image display apparatus 100 according to a user command input through the user input interface unit 150 or an internal program.

The processor 330 may control data transmission with the network interface unit 135 or the external device interface unit 130.

The processor 330 may control operations of the demultiplexer 310, the image processor 320 and the OSD generator 340, which are in the controller 170.

The OSD generator 340 generates an OSD signal automatically or according to user input. For example, the OSD generator 340 may generate, based on a user input signal, a signal for displaying various kinds of information in the form of graphic images or texts on the screen of the display module 180. The generated OSD signal may contain various data including the user interface screen window of the image display apparatus 100, various menu screen windows, widget, and icons. The generated OSD signal may also contain a 2D object or a 3D object.

The OSD generator 340 may generate a pointer which can be displayed on the display module, based on a pointing signal input from the remote control device 200. In particular, the pointer may be generated by a pointing signal processor (not shown), and the OSD generator 340 may include the pointing signal processor. Of course, it is possible to provide the pointing signal processor (not shown) separately from the OSD generator 340.

The mixer 345 may mix the OSD signal generated by the OSD generator 340 and the decoded image signal image-processed by the image processor 320. Here, the OSD signal and the decoded image signal may include at least one of a 2D signal and a 3D signal. The mixed image signal is supplied to a frame rate converter (FRC) 350. The FRC 350 may convert the frame rate of an input image. The frame rate converter 350 can output the frame rate without performing frame rate conversion.

The formatter 360 may arrange the left-eye image frame and the right-eye image frame of the frame rate-converted 3D image. Then, it may output a synchronizing signal Vsync for opening the left-eye glass and the right-eye glass of a 3D viewing device (not shown).

The formatter 360 may receive the mixed signal, that is, the OSD signal and the decoded video signal, from the mixer 345, and separate the same into the 2D image signal and the 3D image signal.

The formatter 360 may convert the 2D image signal into a 3D image signal. The formatter 360 may change the format of the 3D image signal. The formatter 360 may convert the 2D image signal into a 3D image signal.

Although not shown in the figure, a 3D processor (not shown) for 3-dimensional effect signal processing may be further disposed after the formatter 360. The 3D processor (not shown) may perform processing such as adjustment of brightness, tint, or color of an image signal to improve the 3D effect. For example, signal processing to produce a bokeh effect, where objects at a close distance appear sharp while objects at a far distance appear blurred, may be performed. Such function of the 3D processor may be integrated into the formatter 360 or the image processor 320.

An audio processor (not shown) in the controller 170 may process a demultiplexed audio signal. To this end, the audio processor (not shown) may include various decoders.

The audio processor (not shown) in the controller 170 may perform processing such as adjustment of bass, treble, and volume.

The data processor (not shown) in the controller 170 may perform data processing on a demultiplexed data signal. For example, if the demultiplexed data signal is a coded data signal, the data processor (not shown) may decode the data signal. The coded data signal may be electronic program guide (EPG) information containing broadcast information such as a start time and end time of a broadcast program broadcast on each channel.

While FIG. 3 illustrates that the signals from the OSD generator 340 and the image processor 320 are mixed in the mixer 345 and then 3D-processed in the formatter 360, embodiments of the present invention are not limited thereto. That is, the output of the image processor 320 may be 3D-processed by the formatter 360, and the OSD generator 340 may generate and 3D-process an OSD signal. Then, the processed 3D signals may be mixed by the mixer 345.

The block diagram of the controller 170 shown in FIG. 3 is simply illustrative. Constituents of the block diagram may be integrated, added or omitted according to the specification of the controller 170.

In particular, the FRC 350 and the formatter 360 may not be provided in the controller 170. Instead, they may be provided individually or provided as one separate module.

Figure 4:
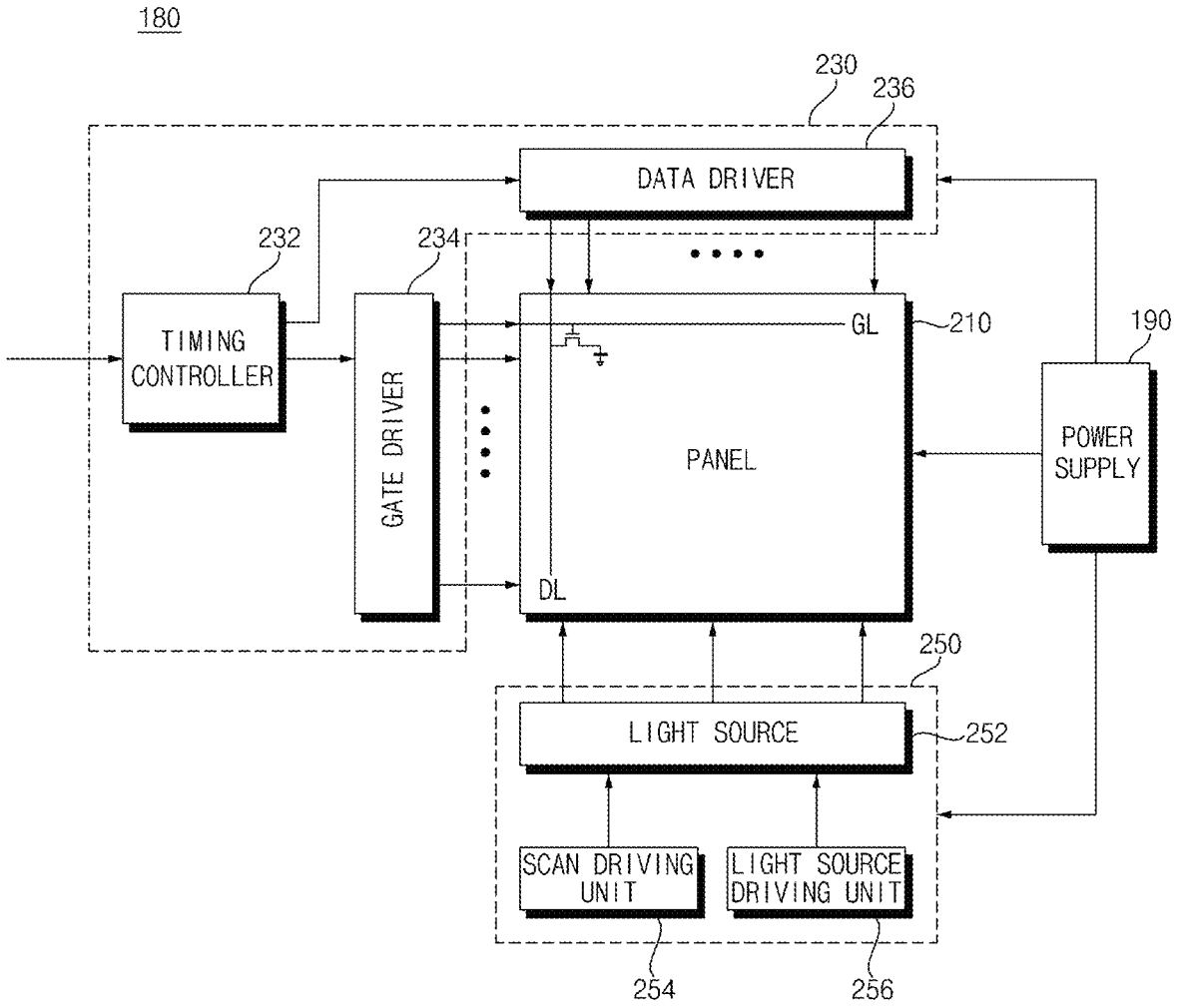
FIG. 4 is an example block diagram of the display module of FIG. 2.

FIG. 4 is an example internal block diagram of the display module of FIG. 2.

Referring to FIG. 4, the display 180, for example a liquid crystal display (LCD) panel, may include an LCD panel 210, a driver circuit unit 230, and a backlight unit 250.

To display images, the LCD panel 210 includes a first substrate on which a plurality of gate lines GL and data lines DL are arranged to intersect each other in a matrix form, and a thin film transistor and a pixel electrode connected thereto are formed in the areas of intersection, a second substrate including a common electrode, and a liquid crystal layer formed between the first substrate and the second substrate.

The driver circuit unit 230 drives the LCD panel 210 through a control signal and a data signal supplied from the control unit 170 of FIG. 1. To this end, the driver circuit unit 230 includes a timing controller 232, a gate driver 234, and a data driver 236.

The timing controller 232 receives a control signal, R, G, and B data signals, and a vertical synchronization signal Vsync input from the control unit 170. The timing controller 232 controls the gate driver 234 and the data driver 236 according to the control signal, rearranges the R, G, and B data signals, and provides the rearranged R, G, and B data signals to the data driver 236.

A scanning signal and an image signal are supplied to the LCD panel 210 through the gate lines GL and the data lines DL under control of the gate driver 234, the data driver 236 and the timing controller 232.

In the case where the display panel 210 is an LCD panel, the display panel 210 is not a self-emitting panel and thus requires the backlight unit 250, as illustrated in the drawing.

The backlight unit 250 supplies light to the LCD panel 210. To this end, the backlight unit 250 may include one or a plurality of light sources 252, a scan driving unit 254 for controlling the scanning operation of the light sources 252, and a light source driving unit 256 for turning on/off the light sources 252.

A predetermined image is displayed using the light emitted from the backlight unit 250 with the light transmittance of the liquid crystal layer adjusted by the electric field formed between the pixel electrode and the common electrode of the LCD panel 210.

In the case where the display module 180 includes an organic light emitting panel, the display panel 180 is a self-emitting panel and thus the backlight unit 250 illustrated in the drawing may be omitted.

However, for simplicity and for the purposes of this discussion, light will be discussed as being output by pixels and subpixels, which will be understood by one or ordinary skill in the art to include not only pixels or subpixels of self-emitting panels but also include light being output via, from, or through pixels or subpixels of non-self-emitting panels where the light may originally be emitted by another element, such as a backlight unit 250.

The power supply 190 supplies a common electrode voltage Vcom to the LCD panel 210 and supplies a gamma voltage to the data driver 236.

The power supply 190 may supply the backlight unit 250 with driving power for driving the light source 252.

Figure 5A:
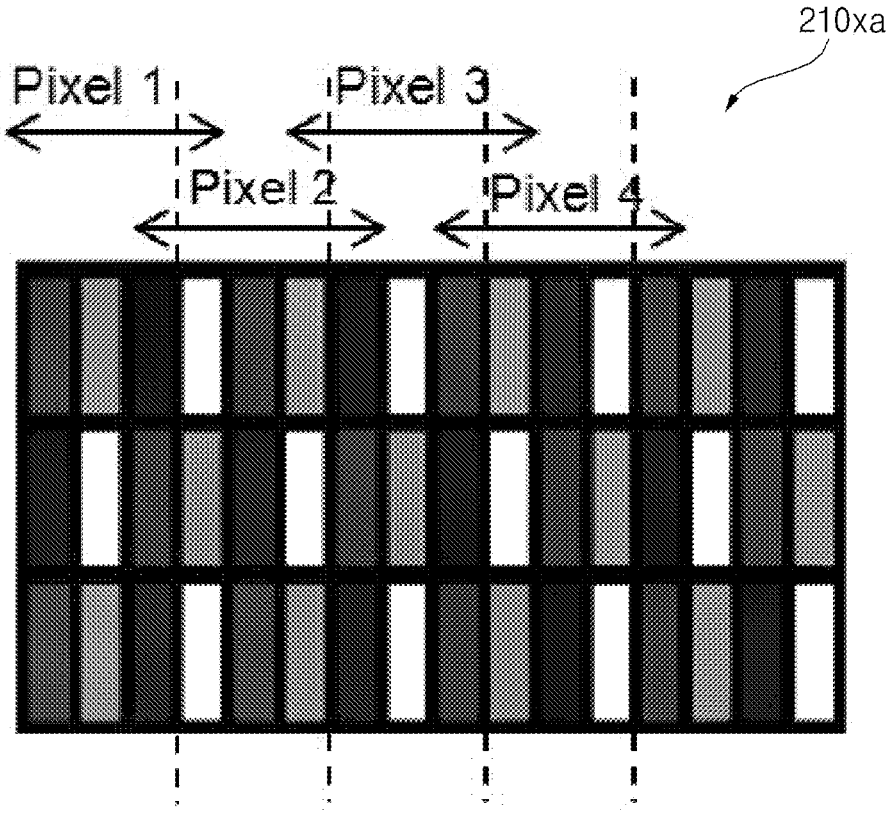
FIGS. 5A to 5C are diagrams illustrating various examples of a panel of FIG. 4.
Figure 5B:
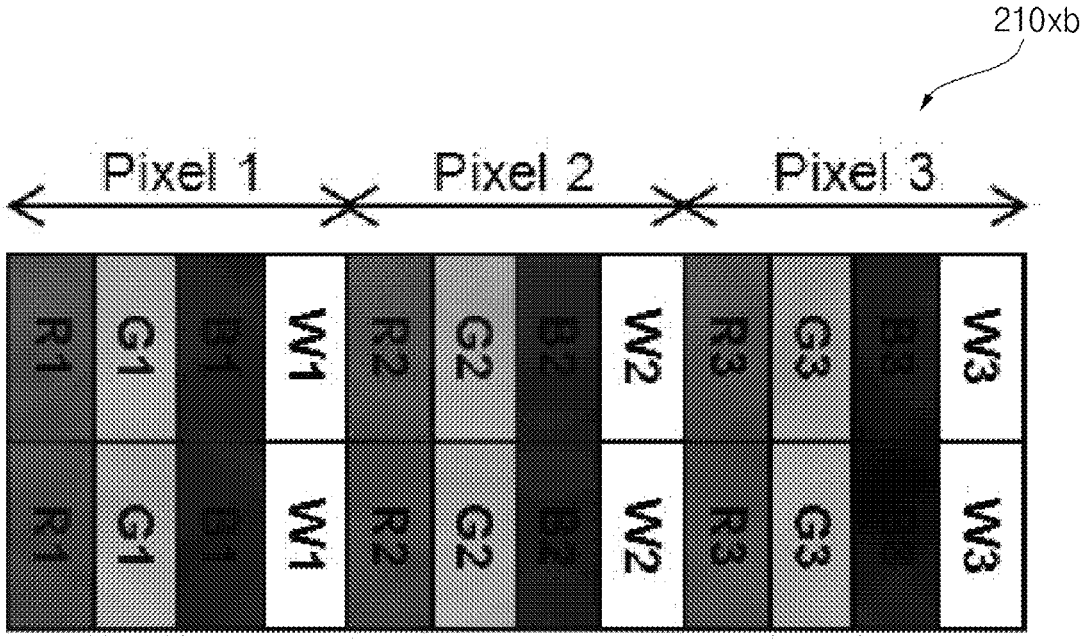
Figure 5C:
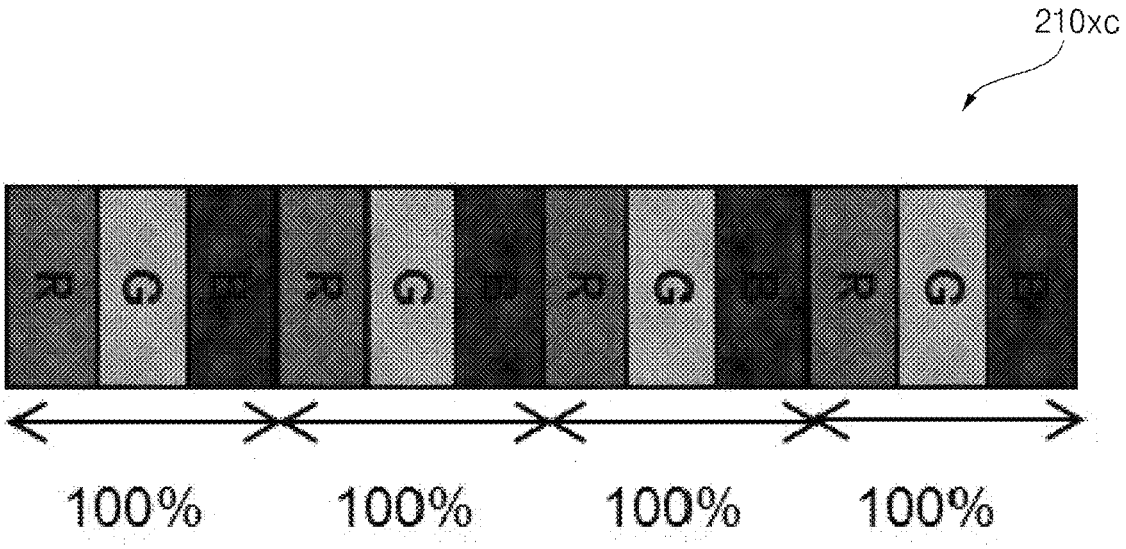

FIGS. 5A to 5C are diagrams illustrating various examples of the panel of FIG. 4. First, FIG. 5A illustrates an example of a panel 210*xa* including red, green, blue, and white (RGBW) subpixels.

Referring to FIG. 5A, the RGBW subpixels are repeatedly arranged, and BWRG subpixels are positioned under the RGBW subpixels, respectively. FIG. 5B illustrates a panel 210*xb* including WRGB subpixels repeatedly arranged. Referring to the drawing, the WRGB subpixels are repeatedly arranged, and WRGB subpixels are positioned under the WRGB subpixels A broadcast image is usually stored and transmitted in the form of a YCbCr signal. The broadcast image is compressed and stored in a 4:2:0 format on the basis of the capability of human eyes to recognize colors. Accordingly, a signal cb and a signal cr has one quarter of the numbers of data of Y signal.

In the case of a computer image or a graphic image, an RGB image signal may be transmitted without compression. In this case, a 4:4:4 format (RGB 4:4:4 or YCbCr 4:4:4) is used, which indicates that the number of luminance data and the number of chromaticity data are identical.

The display module 180 including a non-RGB subpixel structure like the RGBW subpixel structure of FIG. 5A has fewer number of color subpixels compared to an RGB subpixel structure.

The RGBW subpixel structure of FIG. 5A needs a subpixel rendering technique which share neighboring subpixels to enhance brightness and generates new pixel data using a time difference or a filtering principle.

However, if the subpixel rendering technique is used in the RGBW subpixel structure of FIG. 5A, a dramatic change in luminance between lines is limited due to a low-pass filtering effect, thereby reducing line contrast.

In particular, in the case of a high-frequency pattern in which a change in luminance or color relative to a neighboring pixel occurs continuously, for example, a 1×1 line grill pattern image or a 1×1 checkerboard pattern image, a way for maintaining edge sharpness by minimizing a low-pass filtering effect by subpixel rendering is additionally required.

In particular, line contrast greater than a certain level is not necessary to display a broadcast image including a standard viewing distance. However, when close-proximity viewing is required, for example, in the case of a computer image, sharpness is reduced in details of the broadcast image.

In addition, in the case of the RGBW subpixel structure of FIG. 5A, sharpness per pixel is reduced compared to an RGB subpixel structure. That is, contrast modulation (Cm) obtained by measuring display resolution is about 50~60% of resolution in the RGB subpixel structure, and thus, additional efforts are required to improve the resolution.

The WRGB subpixel structure of FIG. 5B is arranged in a stripe shape, and thus, additional subpixel rendering does not need to be performed in the above-described grill pattern image or checkerboard pattern image.

Specifically, in the case of the WRGB structure of FIG. 5B, four subpixels constitute one pixel and thus a subpixel rendering technique is not required. The w subpixel is used for common parts of RGB subpixel data or luminance amplification like a High Dynamic Range (HDR).

However, in the case where resolution of a panel increases to 4K ultra-high definition (UHD), 8K UHD, etc., w subpixels are needed additionally in the WRGB subpixel structure of FIG. 5B, and thus, an additional space for the w subpixels is needed in order to realize resolution identical to resolution in the RGB subpixel structure.

In the case of the panel 210*xb* including WRGB subpixels, when resolution of the panel 210*xb* increases, black matrix increases in proportion to the number of the WRGB subpixels. Accordingly, an area in which each subpixel emits light decreases, which decreases an aperture ratio and results in reducing luminance of the display module.

FIG. 5C illustrates a panel 210*xc* including RGB subpixels repeatedly arranged. In the case of the RGB subpixel structure of FIG. 5C, when resolution of the panel increases to 4K UHD, 8K UHD, etc., black matrix increases in proportion to the number of subpixels. Accordingly, an area in which each subpixel emits light decreases, which decreases an aperture ratio and thereby reduces luminance of the display.

Accordingly, in order to solve the structural problems of the panels shown in FIGS. 5A to 5C, the present invention proposes a display panel including luminance pixels pixelL each including subpixels of multiple colors and color pixels pixelC each including subpixels of multiple colors.

A display panel according to this structure may be referred to as a dual primary display panel.

The multiple colors of the luminance pixels pixelL and the multiple colors of the color pixels pixelC may be identical.

For example, a display panel according to an embodiment of the present invention may include luminance pixels pixelL including RGB subpixels, and color pixels pixelC including RGB subpixels. That is, the luminance pixels pixelL may include subpixels of R, G, B colors, and the color pixels pixelC may include subpixels of R, G, B colors.

In other embodiments, the multiple colors of the luminance pixels pixelL and the multiple colors of the color pixels may be different.

For example, a display panel according to an embodiment of the present invention may include luminance pixels pixelL including CMY subpixels, and color pixels including RGB subpixels. That is, the luminance pixels pixel may include subpixels of cyan (C), magenta (M), and yellow (Y) colors, and the color pixels pixelC may include subpixels of R, G, and B colors.

A display panel according to another embodiment of the present invention may include luminance pixels pixelL including RGB subpixels, and color pixels pixelC including CMY subpixels. That is, the color pixels pixelC may include subpixels of C, M, and Y colors, and the luminance pixels pixelL may include subpixels of R, G, and B colors.

Figure 6A:
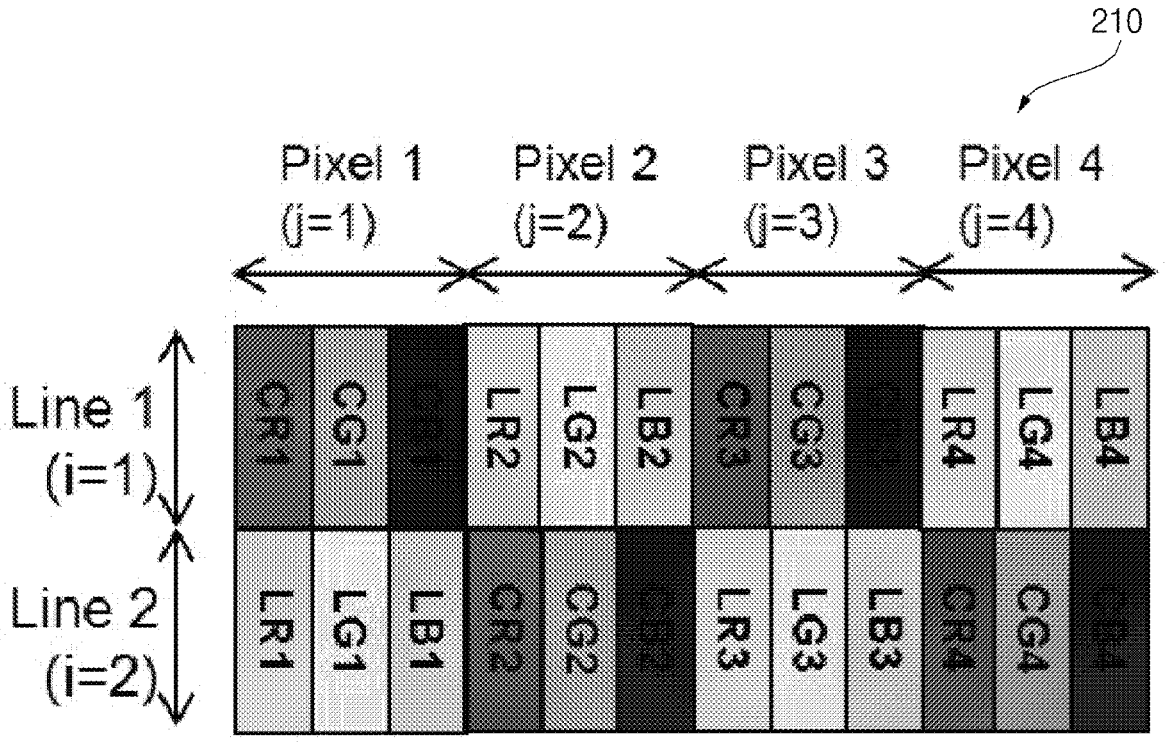
FIGS. 6A to 6B are diagrams illustrating examples of a structure of a display panel according to an embodiment of the present invention.
Figure 6B:
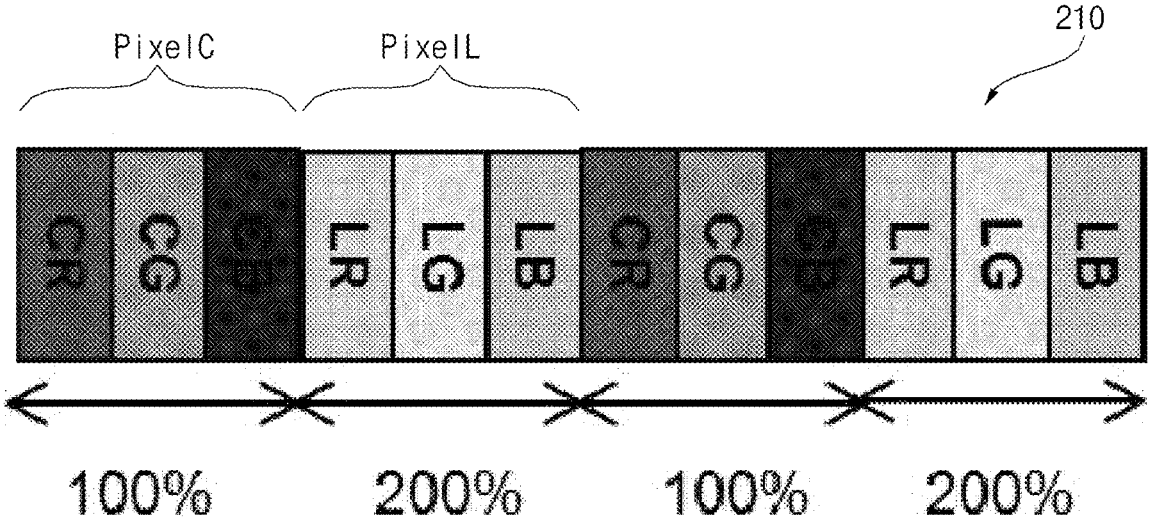

FIGS. 6A to 6B are diagrams illustrating examples of a structure of a display panel according to an embodiment of the present invention.

FIG. 6A illustrates an example in which a display panel 210 includes: Pixel 1 on Line 1 which is a color pixel and includes subpixels CR1, CG1, and CB1; Pixel 2 on Line 1 which is a luminance pixel and includes subpixels LR2, LG2, and LB2; and Pixel 1 on Line 2 which is a luminance pixel and includes subpixels LR1, LG1, and LB1.

FIG. 6B illustrates an example in which the display panel 210 includes color pixels pixelC including subpixels CR, CG, and CB, and luminance pixels pixelL including subpixels LR, LG, and LB.

According to the structures of the display panel 210 in FIGS. 6A and 6B, high luminance and high color saturation may be achieved by the color pixels pixelC primarily for chromaticity and the luminance pixels pixelL primarily for luminance.

In particular, the luminance pixels pixelL output light with luminance higher than luminance of the color pixels pixelC, and the color pixels pixelC output light with color purity higher than color purity of the luminance pixel pixelL.

For example, as illustrated in FIG. 6B, in the case where brightness of a luminance pixel pixelL is two times higher than brightness of a color pixel pixelC and thus asymmetric thereto, brightness of the display panel 210 at the corresponding luminance pixel may increase to be about 1.5 times higher than the brightness of the color pixel pixelC or a conventional pixel.

Accordingly, the structures of the display panel 210 in FIGS. 6A and 6B may achieve sharpness and Cm between lines, which are identical to those of the RGB structure of FIG. 5C, without employing the subpixel rendering technique used in the RGBW structure of FIG. 5A. That is, high luminance and high color saturation may be reproduced.

In addition, in the case of the structures of the display panel 210 in FIGS. 6A and 6B, resolution identical to resolution in the conventional RGB structure of FIG. 5C may be achieved even though the resolution is determined based on the number of pixels. Meanwhile, in the case of the structures of the display panel 210 in FIGS. 6A and 6B, the color pixels pixelC and the luminance pixels pixelL are arranged alternatively in upward, downward, leftward, and rightward directions.

In addition, as shown in FIG. 6A, the display panel 210 may have a 1×1 checkerboard pattern. According to this checkerboard pattern structure, the color pixels pixelC and the luminance pixels pixelL may be used selectively or in combination, thereby achieving both high color saturation and high luminance.

Meanwhile, in the case of the structures of the display panel 210 in FIGS. 6A and 6B, contrast modulation (Cm) on a pixel unit basis in horizontal and vertical directions may be identical to that of the RGB subpixel structure of FIG. 5C, and brightness of an entire screen may be enhanced compared to that of the RGB subpixel structure of FIG. 5C.

According to the structure of the display panel 210, two types of pixels including three primary color subpixels, including one type of a color pixel pixelC and another type of a luminance pixel pixelL, may be arranged in a checkerboard pattern. Accordingly, brightness and a color gamut of the display module may be achieved at the same time.

Meanwhile, in a conventional RGBW subpixel structure for increasing brightness 1.5 times, a sub-pixel rendering (RSR) technique is controlled adaptively according to a type of a signal input to the display module 180, thereby reducing sharpness per pixel on a screen compared to the RGB subpixel structure. That is, contrast modulation (Cm) obtained by measuring resolution of the display is lower than that of the RGB subpixel structure, and an additional improvement process is needed.

In the structure according to embodiments of the present invention, pixels having three primary colors of R, G, and B are composed of subpixels primarily for luminance and subpixels primarily for chromaticity, thereby achieving two objects of high luminance and a wide color gamut. In this case, while contrast modulation (Cm) on a pixel unit basis in horizontal and vertical directions is maintained at a value identical to that of the RGB subpixel structure, brightness of the entire screen is enhanced compared to the RGB subpixel structure.

Meanwhile, the pixel structure shown in FIGS. 6A and 6B complies with the general definition of pixel. Even in the case of determining resolution based on the number of pixels, the resolution of the pixel structure shown in FIGS. 6A and 6B is measured to be identical to that of the conventional RGB pixel structure. Thus, the pixel structure shown in FIGS. 6A and 6B does not have problems often occurring in the multi-primary display module 180 in regard with pixel definition and resolution.

In the dual primary color pixel structure of the present invention, color pixels and luminance pixels are arranged alternatively in upward, downward, leftward, and rightward directions to form a 1×1 checkerboard pattern. If the checkerboard pattern is ignored and an image signal is displayed in the same manner a conventional display module does, the display module may be used with a middle luminance level between color pixels and luminance pixels and a middle color gamut therebetween. Yet, embodiments of the present invention have advantageous effects that two types of pixels are used selectively or in combination, achieving high color saturation and high luminance at the same time.

Figure 7:
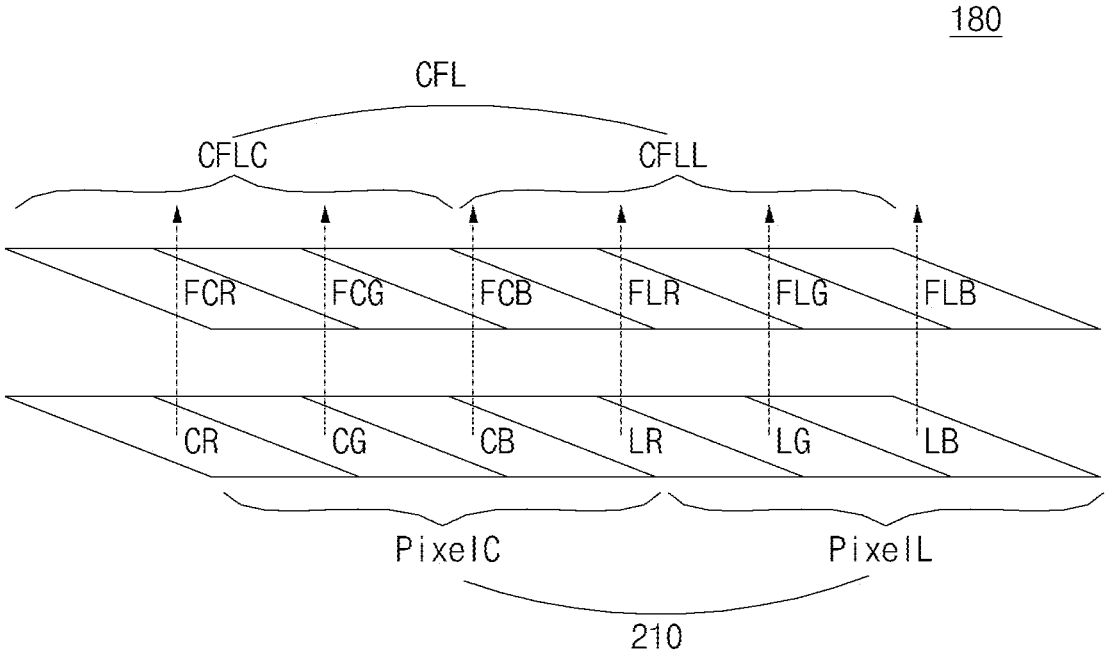
FIG. 7 is a diagram illustrating a structure of a display module according to an embodiment of the present invention.

FIG. 7 is a diagram illustrating a structure of a display module according to an embodiment of the present invention.

Referring to FIG. 7, a display module 180 according to an embodiment of the present invention may include a display panel 210 including color pixels pixelC and luminance pixels pixelL, and a color filter CFL on the display panel 210.

The color filter CFL may include a color-saturation color filter CFLC corresponding to the color pixels pixelC, and luminance color filter CFLL corresponding to the luminance pixels pixelL.

The luminance color filter CFLL is disposed on pixels of multiple colors of the luminance pixels pixelL.

The color-saturation color filter CFLC is disposed on subpixels of multiple colors of the color pixels pixelC.

A wavelength width of light transmitted through the luminance color filter CFLL is preferably greater than a wavelength width of light transmitted through the color-saturation color filter CFLC. The color-saturation color filter CFLC preferably has a light transmittance greater than a light transmittance of the luminance color filter CFLL.

Accordingly, light output through the luminance color filter CFLL may have luminance higher than luminance of light output through the color-saturation color filter CFLC.

Meanwhile, the light output through the color-saturation color filter CFLC may output light with color purity higher than color purity of light output through the luminance color filter CFLL.

Accordingly, a high luminance and high color-saturation image may be displayed through the display module 180 according to an embodiment of the present invention. In addition, a high-resolution image may be displayed.

Figure 8A:
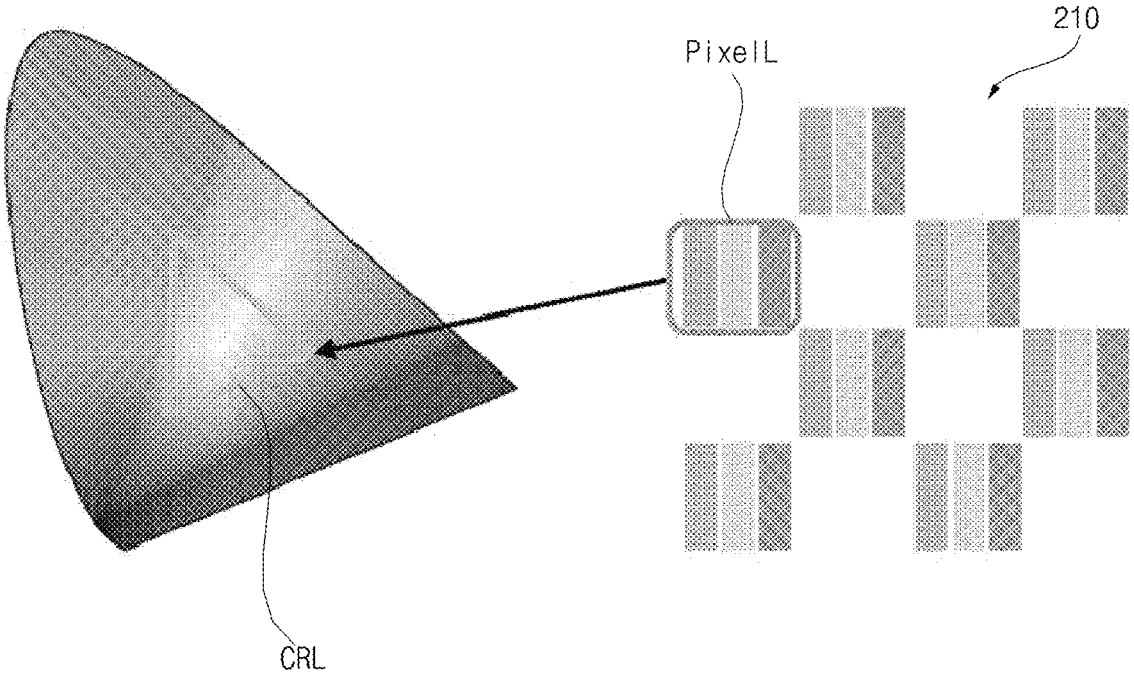
FIG. 8A is a diagram illustrating a color gamut of a luminance pixel of FIG. 6B.
Figure 8B:
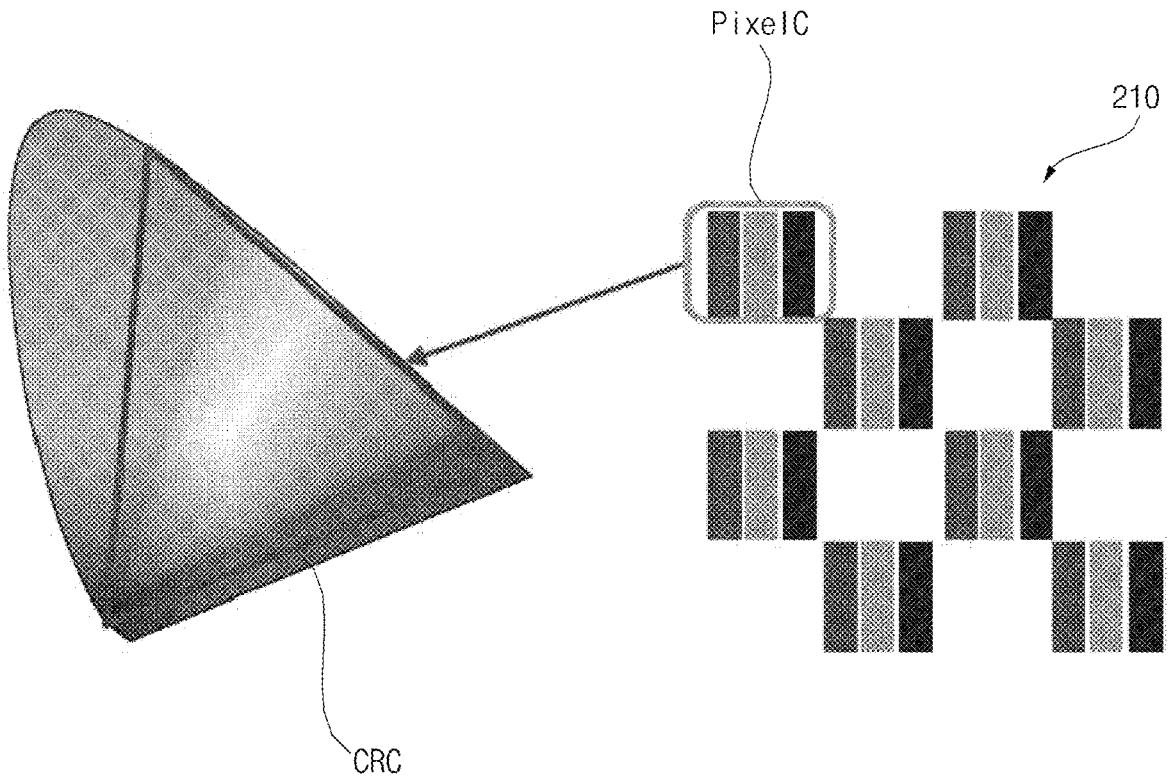
FIG. 8B is a diagram illustrating a color gamut of a color pixel of FIG. 6B.
Figure 8C:
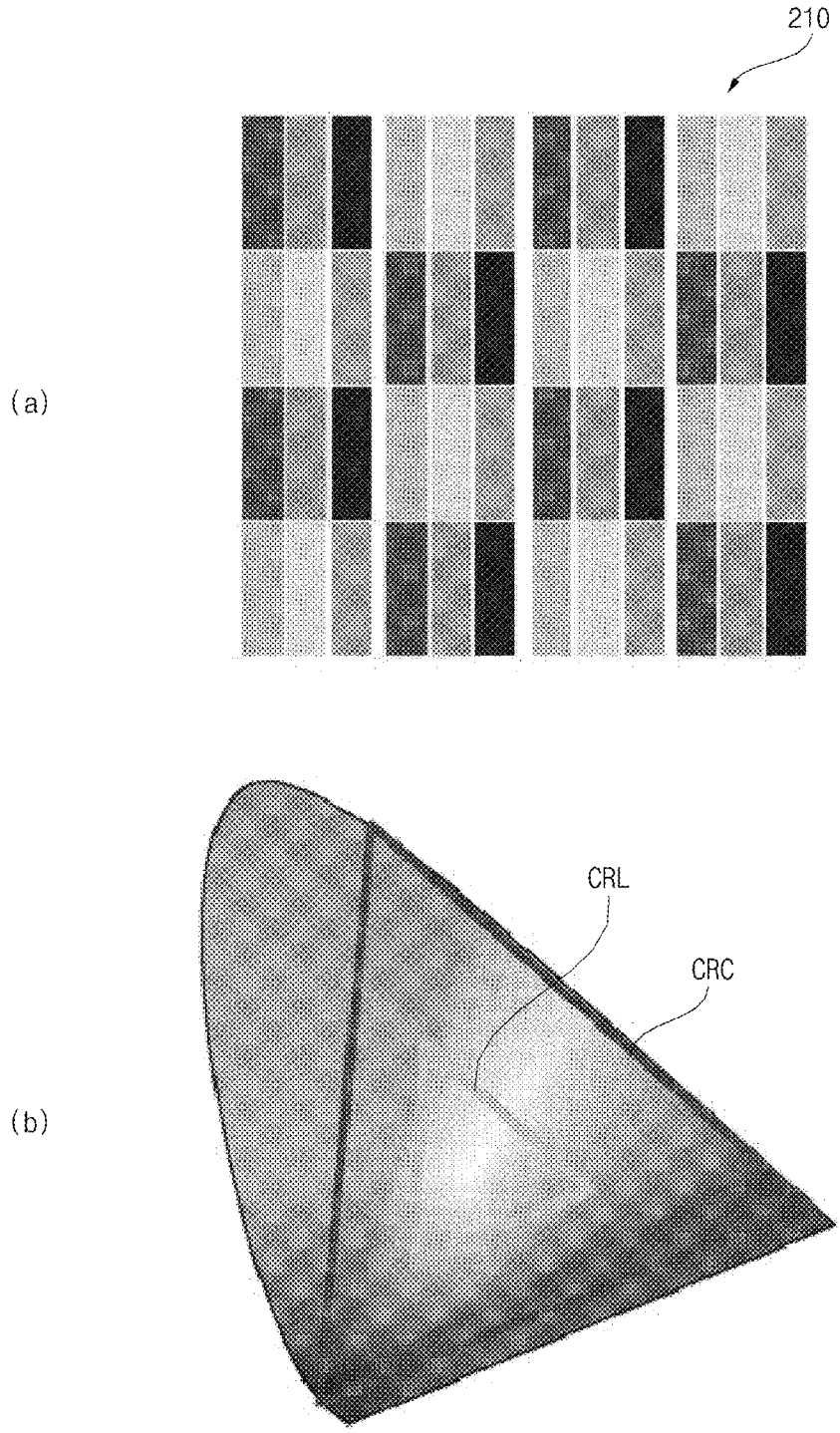
FIG. 8C is a diagram illustrating both the color gamut of the luminance pixel of FIG. 6B and the color gamut of the color pixel of FIG. 6B.

FIG. 8A is a diagram illustrating a color gamut of a luminance pixel pixelL of FIG. 6B, and FIG. 8B is a diagram illustrating a color gamut of a color pixel pixelC of FIG. 6B, and FIG. 8C is a diagram illustrating both the color gamut of the luminance pixel pixelL of FIG. 6B and the color gamut of the color pixel pixelC of FIG. 6B.

Referring to the drawings, a color gamut CRL of luminance pixels pixelL of FIG. 8A is presented narrower than a color gamut CRC of color pixels pixelC of FIG. 8B.

That is, the color gamut CRC of the color pixels pixelC of FIG. 8B is presented wider than the color gamut CRL of the luminance pixels pixelL of FIG. 8A.

In the case where the luminance pixels pixelL and the color pixels pixelC are alternatively arranged in a checkerboard pattern, the color gamut CRL of the luminance pixels pixelL and the color gamut CRL of the luminance pixel pixelL may be presented together.

Thus, in the case where the luminance pixels pixelL and the color pixels pixelC are alternatively arranged in a checkerboard pattern as shown in FIG. 8C, a high luminance image may be displayed with a wide color gamut.

In the case where an input image is a grill pattern image including a black area, a way of displaying the grill pattern image in various subpixel structures will be described.

Figure 9A:
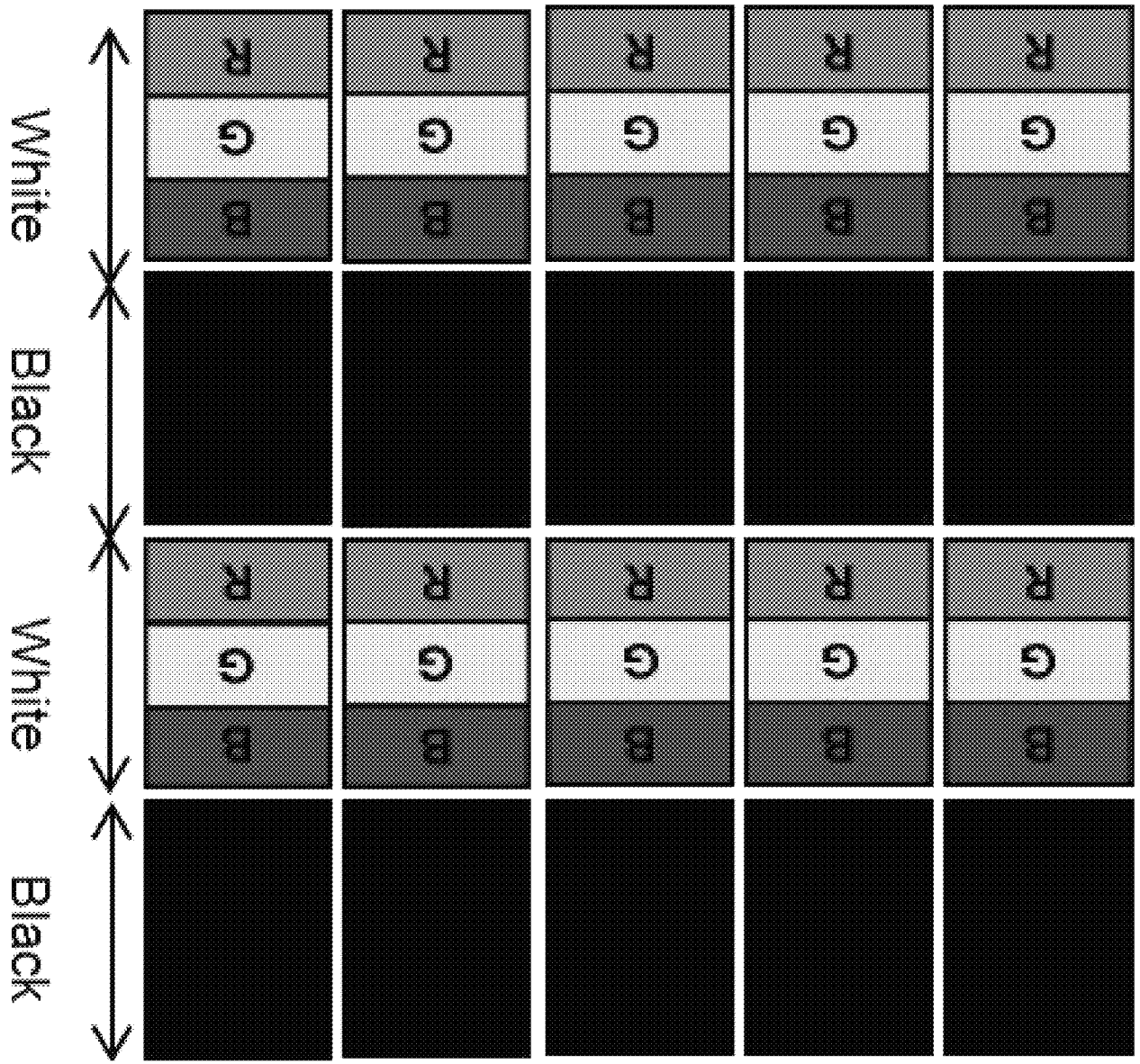
FIG. 9A illustrates an example in which a grill pattern image including a black area is displayed in an RGB subpixel structure.

FIG. 9A illustrates an example in which a grill pattern image including straight black lines is displayed in an RGB subpixel structure.

Referring to FIG. 9A, in the RGB subpixel structure, with reference going from left to right, a first RGB subpixel line emits light, a second RGB subpixel adjacent to the first RGB subpixel is turned off, a third RGB subpixel adjacent to the second RGB subpixel emits light, and a fourth RGB subpixel line adjacent to the third RGB subpixel is turned off.

Figure 9B:
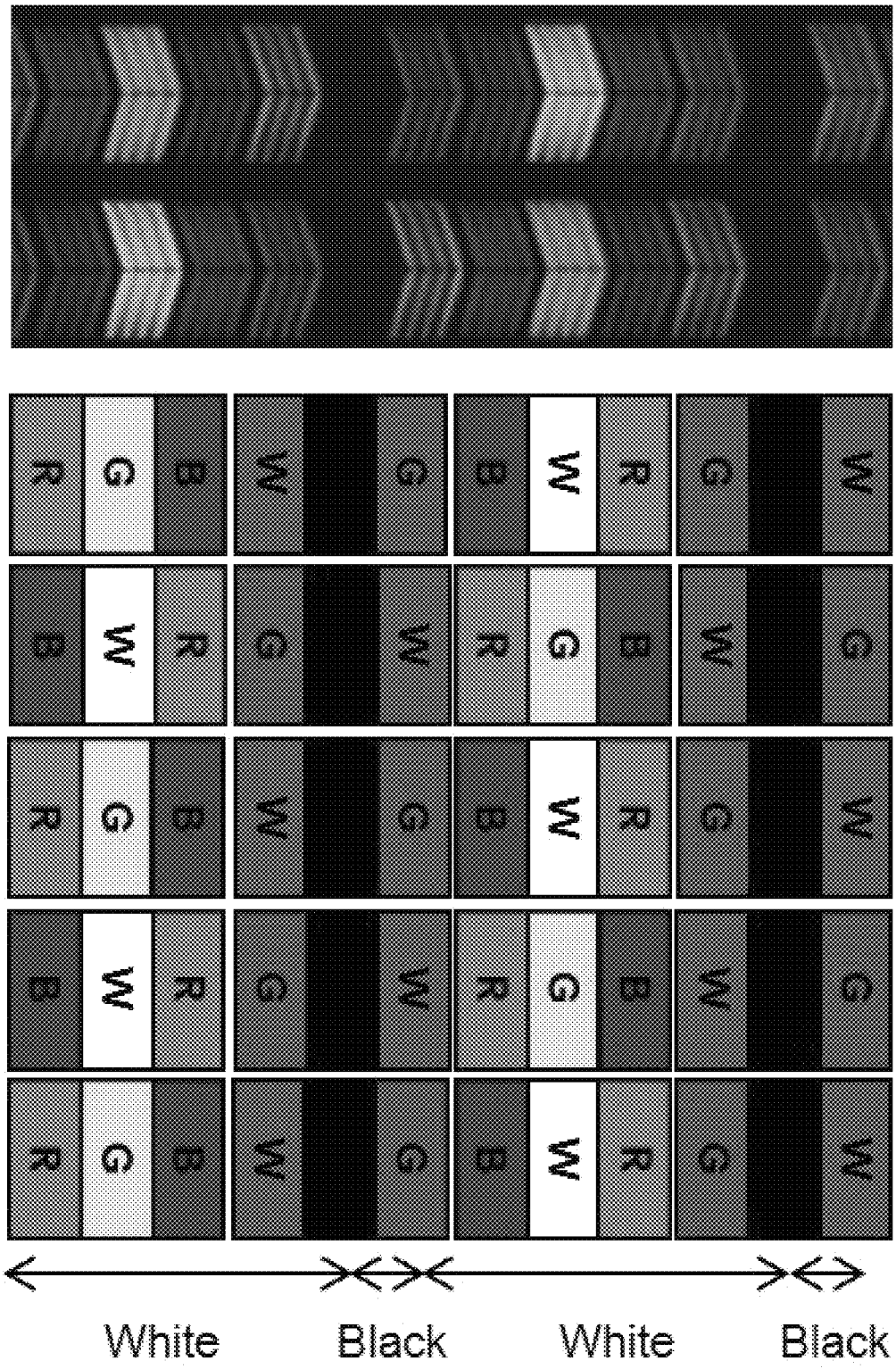
FIG. 9B illustrates an example in which a grill pattern image including a black area is displayed in a WRGB subpixel structure.

FIG. 9B illustrates an example in which a grill pattern image including a black area is displayed in a WRGB subpixel structure.

Referring to FIG. 9B, in the WRGB subpixel structure, with reference to the top left portion going from left to right, RGB subpixels emit light, WRG subpixels adjacent to the RGB subpixels are turned off, BWR subpixels adjacent to the WRG subpixels emit light, and GBW subpixels adjacent to the BWR subpixels are turned off.

In the WRGB subpixel structure, a subpixel rendering operation is performed to display an image, and therefore, there is a problem that the grill pattern image including the black area cannot be displayed with sharpness, as shown in the resulting image shown at the top of FIG. 9B.

Figure 9C:
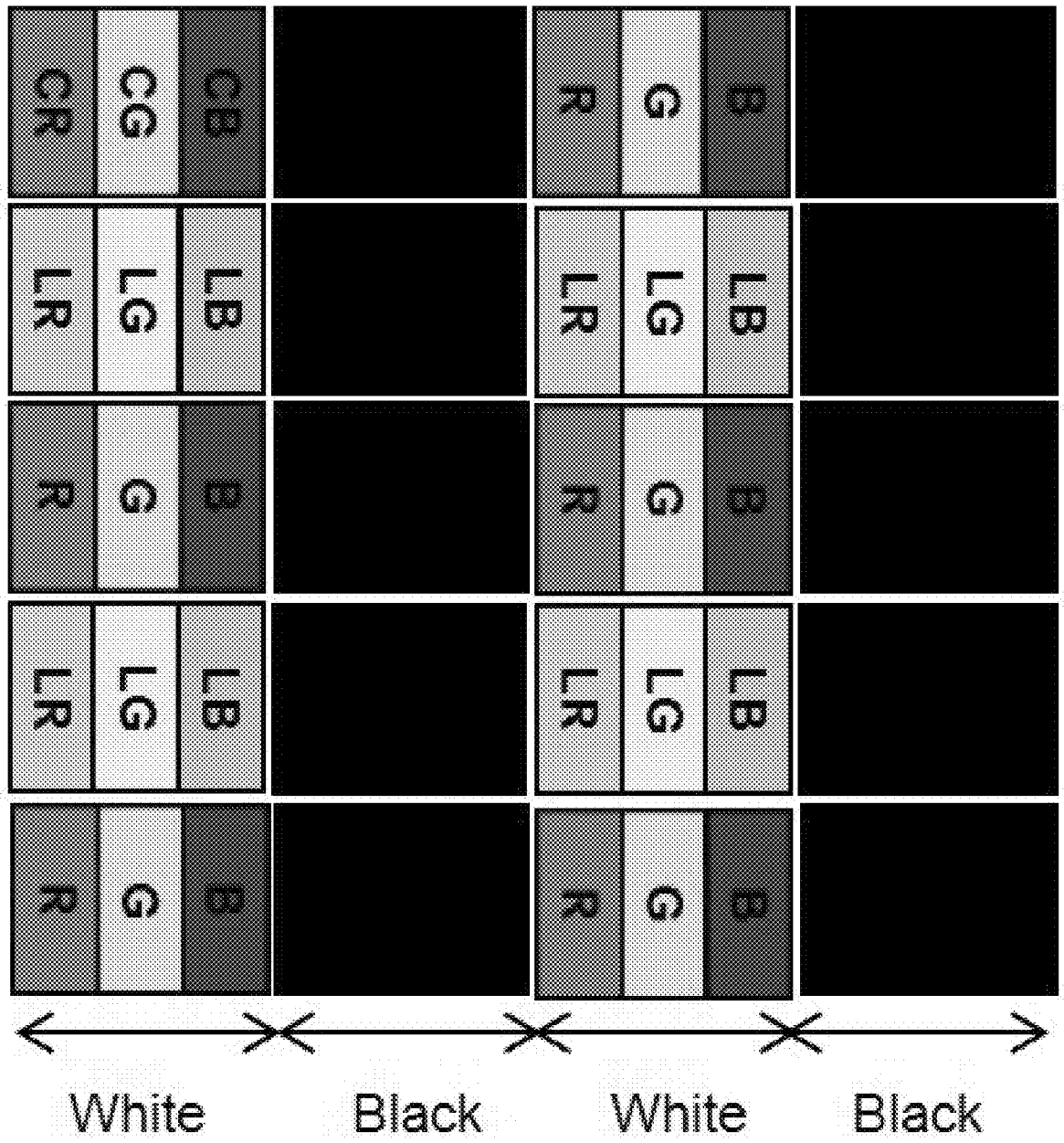
FIG. 9C illustrates an example in which a grill pattern image including a black area is displayed in a structure including luminance pixels and color pixels according to an embodiment of the present invention.

FIG. 9C illustrates an example in which a grill pattern image including straight black lines is displayed in a structure including luminance pixels pixelL and color pixels pixelC according to an embodiment of the present invention.

Referring to FIG. 9C, in the structure including luminance pixels pixelL and color pixels pixelC, with reference to the top left portion going from left to right, RGB subpixels in a color pixel pixelC emits light while RGB subpixels in a luminance pixel pixelL adjacent to the color pixel pixelC are turned off.

Meanwhile, with reference to the second line from the left, RGB subpixels in a luminance pixel pixelL emit light while RGB subpixels in a color pixel pixelC adjacent to the luminance pixel pixelL are turned off.

That is, in the case of displaying a grill pattern image including straight black lines in the structure including luminance pixels pixelL and color pixels pixelC according to an embodiment of the present invention, a subpixel rendering operation is not performed and therefore the grill pattern image including the black area is displayed with sharpness.

In the case where luminance pixels pixelL and color pixel pixelC are arranged in a checkerboard pattern, when an input image is a grill pattern image including black lines, the controller 170 or the timing controller 232 may display the grill pattern without performing a subpixel rendering operation to transfer luminance data to an adjacent color pixel pixelC or an adjacent luminance pixel pixelL with respect to the black area. Accordingly, the grill pattern image may be displayed with sharpness.

Figure 10A:
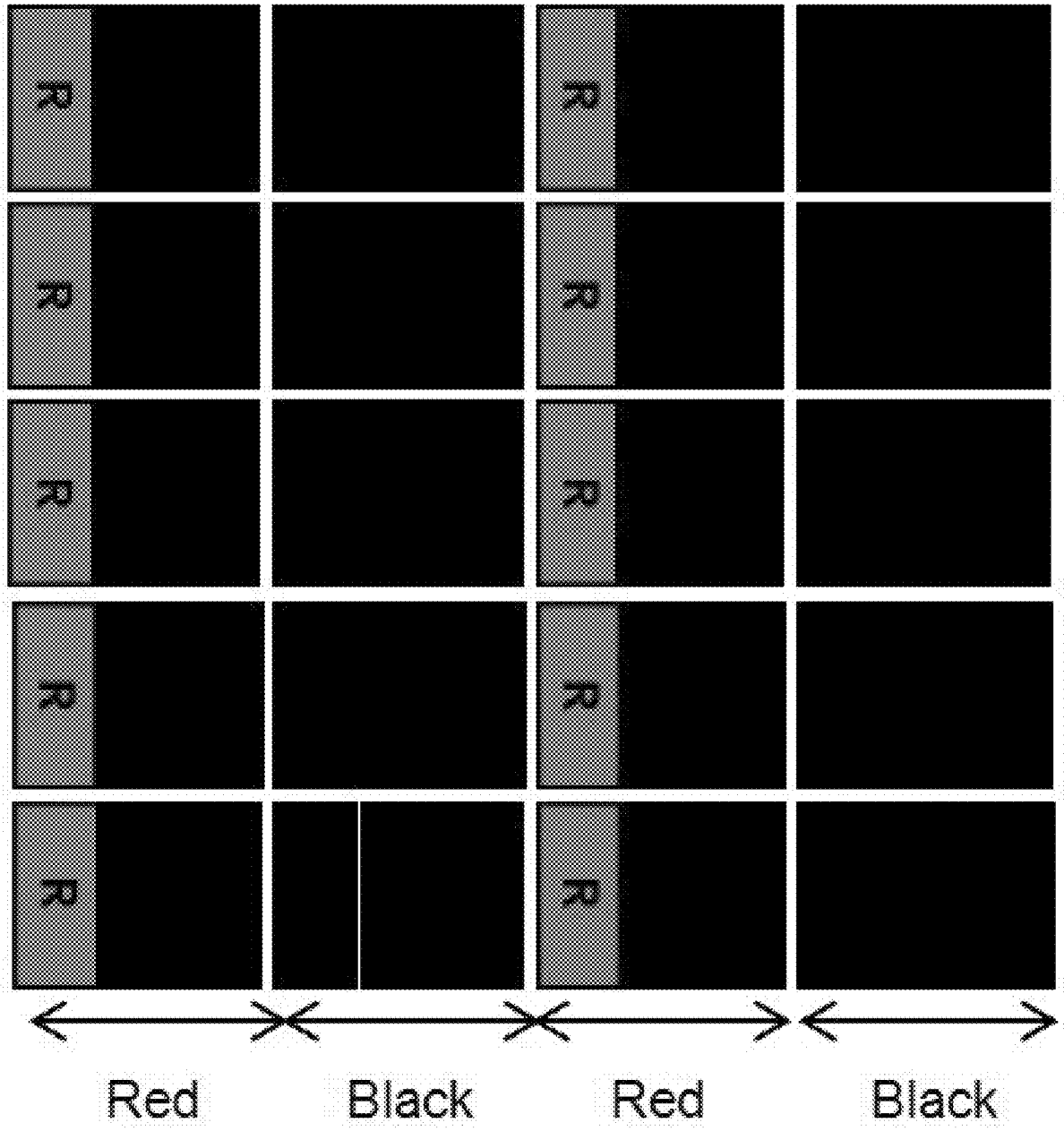
FIG. 10A illustrates an example in which a color grill pattern image including a black area is displayed in an RGB subpixel structure.

FIG. 10A illustrates an example in which a color grill pattern image including a black area is displayed in an RGB subpixel structure.

Referring to the drawing, in the RGB subpixel structure, with reference going from left to right, an R subpixel in a first RGB subpixel line emits light, a second RGB subpixel line adjacent to the first RGB subpixel is turned off, an R subpixel in a third RGB subpixel line adjacent to the second RGB subpixel emits light, and a fourth RGB subpixel line adjacent to the third RGB subpixel is turned off.

Figure 10B:
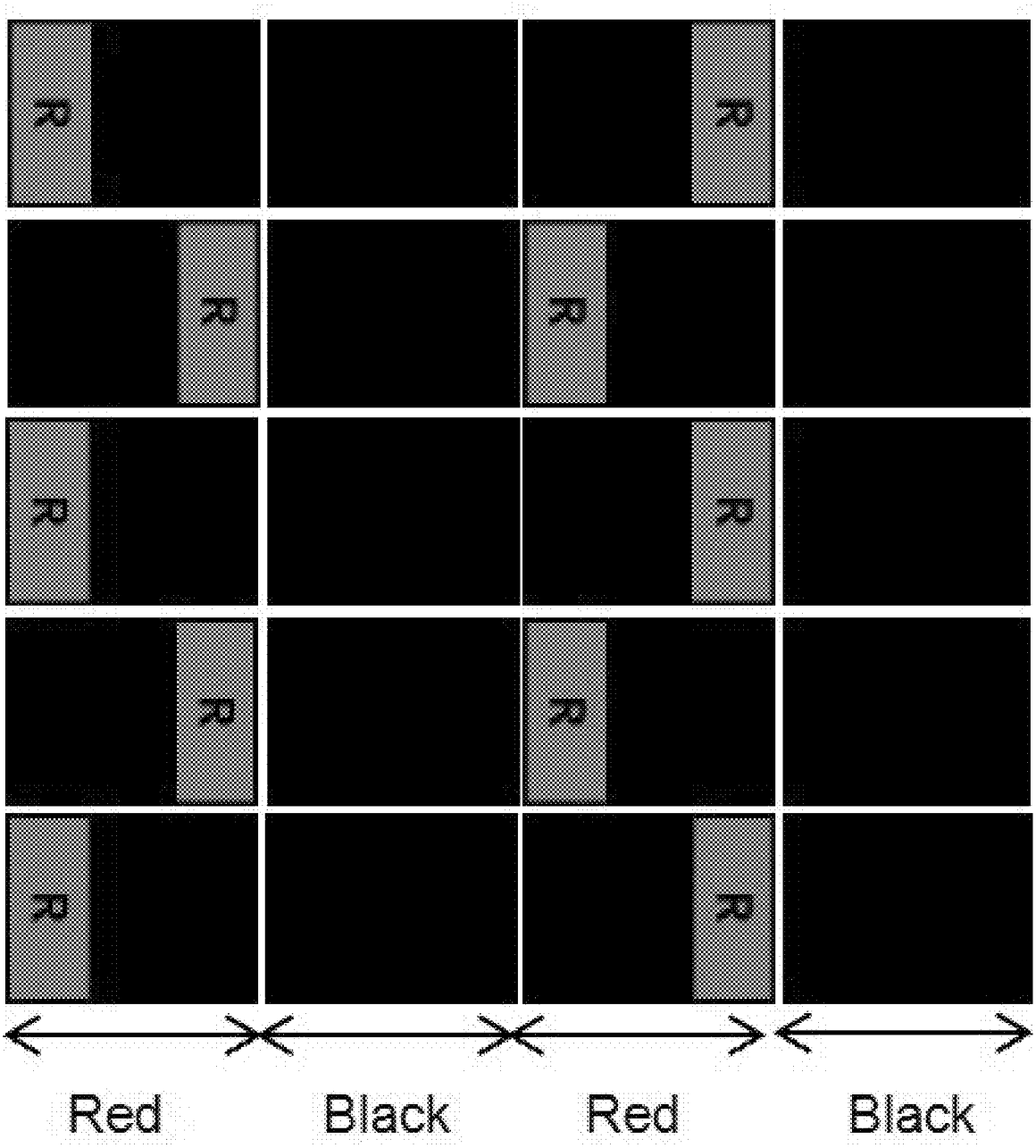
FIG. 10B illustrates an example in which a color grill pattern image including a black area is displayed in a WRGB subpixel structure.

FIG. 10B illustrates an example in which a color grill pattern image including a black area is displayed in a WRGB subpixel structure.

Referring to the drawing, in the WRGB subpixel structure, with reference to the top left portion going from left to right, an R subpixel out of RGB subpixels emits light, WRG subpixels adjacent to the RGB subpixels are turned off, an R subpixel in BWR subpixels adjacent to the WRG subpixels emits light, and GBW subpixels adjacent to the BWR subpixels are turned off.

Meanwhile, in the WRGB subpixel structure, there are repeated areas in which R subpixels emit light however the R subpixels across the display are not aligned, and therefore, the color grill pattern image cannot be displayed with sharpness, as shown in the drawing.

Figure 10C:
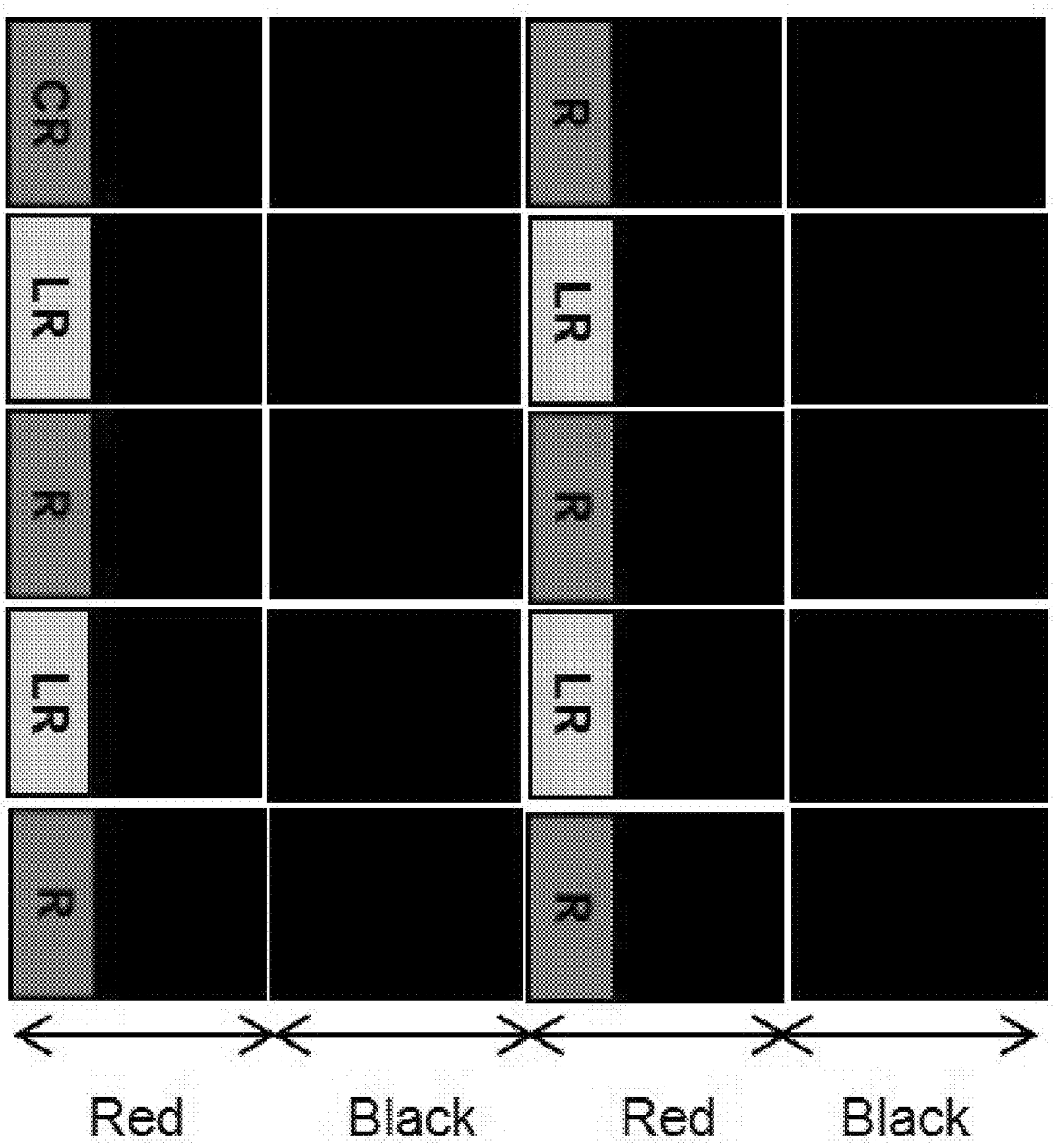
FIG. 10C illustrates an example in which a color grill pattern image including a black area is displayed in a structure including luminance pixels and color pixels according to an embodiment of the present invention.

FIG. 10C illustrates an example in which a color grill pattern image including a black area is displayed in a structure including luminance pixels pixelL and color pixels pixelC according to an embodiment of the present invention.

Referring to the drawing, in the structure including the luminance pixel pixelL and the color pixel pixelC, with reference to the top left portion going from left to right, an R subpixel out of RGB subpixels in a color pixel pixelC emits light while RGB subpixels in a luminance pixel pixelL adjacent to the corresponding color pixel pixelC is turned off.

Meanwhile, with reference to the second line from the left side, an R subpixel out of RGB subpixels in a color pixel pixelC emits light, and RGB subpixels in the luminance pixel pixelL adjacent to the luminance pixel pixelL are turned off.

That is, in the case of displaying a color grill pattern image including a black area in the structure including luminance pixels pixelL and color pixels pixelC according to an embodiment of the present invention, a subpixel rendering operation is not performed and therefore the color grill pattern image including black area is displayed with sharpness.

Figure 11A:
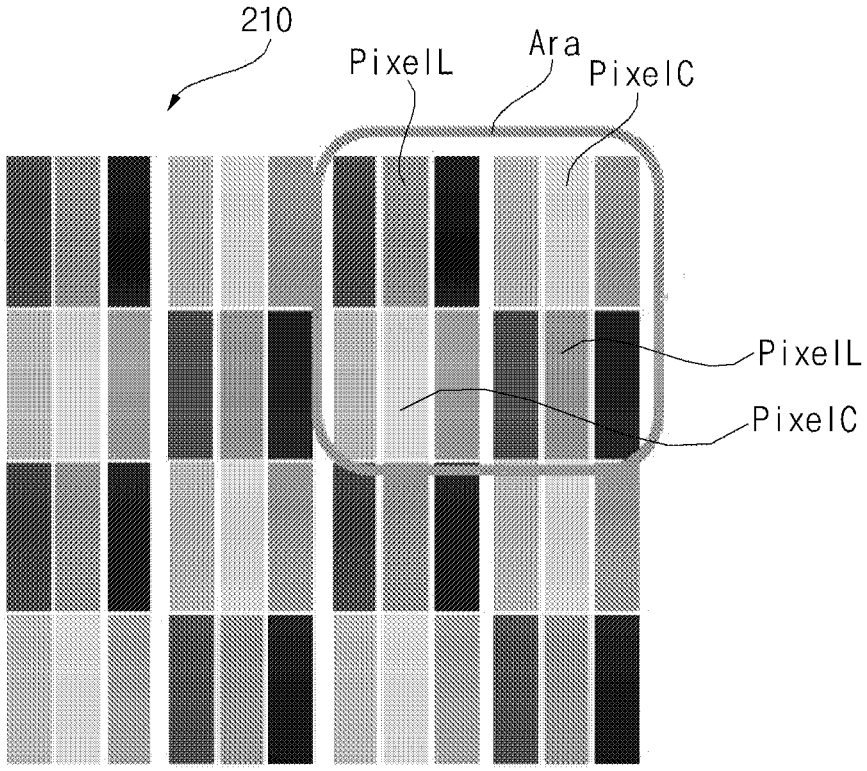
FIG. 11A is a diagram illustrating a display panel according to an embodiment of the present invention.

FIG. 11A is a diagram illustrating a display panel according to an embodiment of the present invention.

Referring to FIG. 11A, a display panel 210 may include color pixels pixelC including subpixels CR, CG, and CB, and luminance pixels pixelL including subpixels LR, LG, and LB.

According to the structure of the display panel 210 of FIG. 11A, high luminance and high color-saturation may be reproduced by the color pixels pixelC for color saturation and the luminance pixels pixelL for luminance.

In particular, the luminance pixels pixelL outputs light with luminance higher than luminance of light output from the color pixel pixelC, and the color pixel pixelC outputs light with color purity higher than color purity of light output from the luminance pixel pixelL.

An area Ara in the drawing includes four pixels, specifically two color pixels pixelC and two luminance pixels pixelL.

In this case, according to chromaticity of an input image signal, luminance pixels pixelL with high luminance may be used alone or the luminance pixels pixelL and color pixels pixelC may be used together at the same time.

To this end, the controller 170 or the timing controller 232 may divide the input image into luminance pixel data for displaying the image in the luminance pixels pixelL and color pixel data for displaying the image in the color pixels pixelC, and output at least one of the luminance pixel data or the color pixel data. Accordingly, a high luminance and high color-saturation image may be displayed.

The controller 170 or the timing controller 232 may change luminance of the luminance pixel data or luminance of the color pixel data to be different from luminance of the input image, and change a color gamut of the luminance pixel data or a color gamut of the color pixel data to be different from a color gamut of the input image. Accordingly, a high luminance and high color-saturation image may be displayed.

The controller 170 or the timing controller 232 may set a luminance variable gain for the luminance pixel data and a luminance variable gain for the color pixel data to be different. Accordingly, a high luminance image may be displayed.

In the case where the display panel 210 is an organic light emitting panel which is a self-emitting panel, the controller 170 or the timing controller 232 may calculate an Average Picture Level (APL) of an input image, convert a luminance level of the input image into a set luminance level based on the calculated APL, and output at least one of the luminance pixel data or the color pixel data based on the converted luminance level. Accordingly, a high luminance and high color-saturation image may be displayed while a driving operation with low power consumption is performed according to an APL.

For example, the controller 170 or the timing controller 232 may perform control such that as a calculated APL is higher, a converted luminance level obtained in response to the luminance level conversion is lower. Based on the converted luminance level, the controller 170 or the timing controller 232 may output at least one of the luminance pixel data or the color pixel data. Accordingly, a high luminance and high color-saturation image may be displayed while a driving operation with low power consumption is performed according to the APL.

Meanwhile, when color saturation of an area in an input image is equal to or lower than a first color-saturation threshold, the controller 170 or the timing controller 232 may output only luminance pixel data. Accordingly, a high luminance image may be displayed.

When color saturation of an area in an input image is higher than the first color-saturation threshold, the controller 170 or the timing controller 232 may perform control such that luminance pixel data and color pixel data are output together. Accordingly, a high luminance image and a high color-saturation image is displayed.

That is, high luminance pixels are used in response to an image signal with low color saturation, and both high color pixels and the high luminance pixels are used in response to an image signal with high color saturation.

Generally, an image signal is transmitted in YCbCR format. In the case of a 4:2:0 format, chroma signals Cb and Cr are generated per 2×2 pixel, as illustrated in FIG. 11A, and therefore, the same information of chromaticity is given for four pixels in a 2×2 area Ara.

Thus, even when four pixels are used in combination, not individually, with respect to four image signals of the 2×2 area Ara, there is no problem in reproducing chromaticity.

Figure 11B:
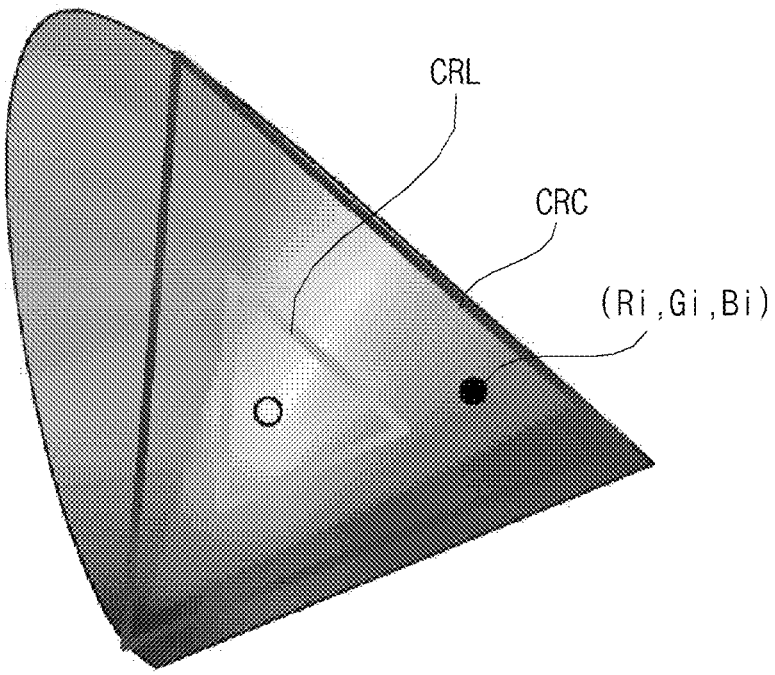
FIG. 11B is a diagram illustrating a color gamut of the display panel of FIG. 11*a*.

FIG. 11B is a diagram illustrating a color gamut of the display panel of FIG. 11*a*.

Referring to FIG. 11B, a color gamut of luminance pixels pixelL and a color gamut of color pixels pixelC are both illustrated.

In FIG. 11B, a color gamut CRL of luminance pixels pixelL is narrower than a color gamut CRC of color pixels pixelC. That is, the color gamut CRC of the color pixels pixelC is wider than the color gamut CRL of the luminance pixels pixelL.

In the case where the luminance pixels pixelL and the color pixels pixelC are used together, if there is image data $(R_i,G_i,B_i)$ like the color of the black dot in FIG. 11B, achromatic components of the image data $(R_i,G_i,B_i)$ does not have color saturation and thus it would be better to be presented with high luminance pixel values $(R_L,G_L,B_L)$. Accordingly, components other than the achromatic components displayed using high luminance pixels in the image data $(R_i,G_i,B_i)$ may be displayed using high color pixels. That is, the controller 170 or the timing controller 232 may perform control such that luminance pixel data and color pixel data are output with respect to any area other than an achromatic area in an input image. Accordingly, a high luminance and high color-saturation image may be displayed.

Figure 12:
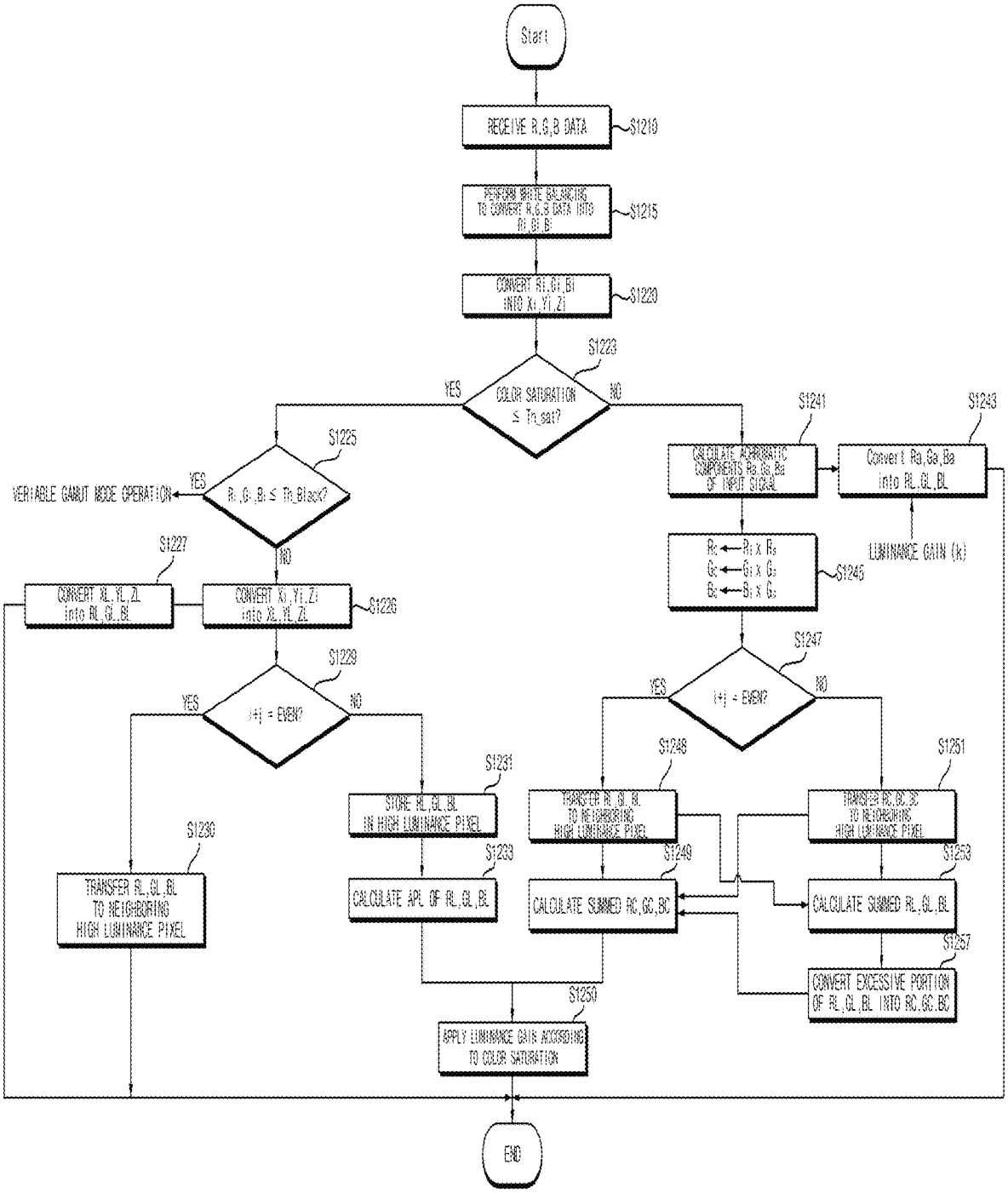
FIG. 12 is a flowchart illustrating an operation method of an image display apparatus according to an embodiment of the present invention.
Figure 13B:
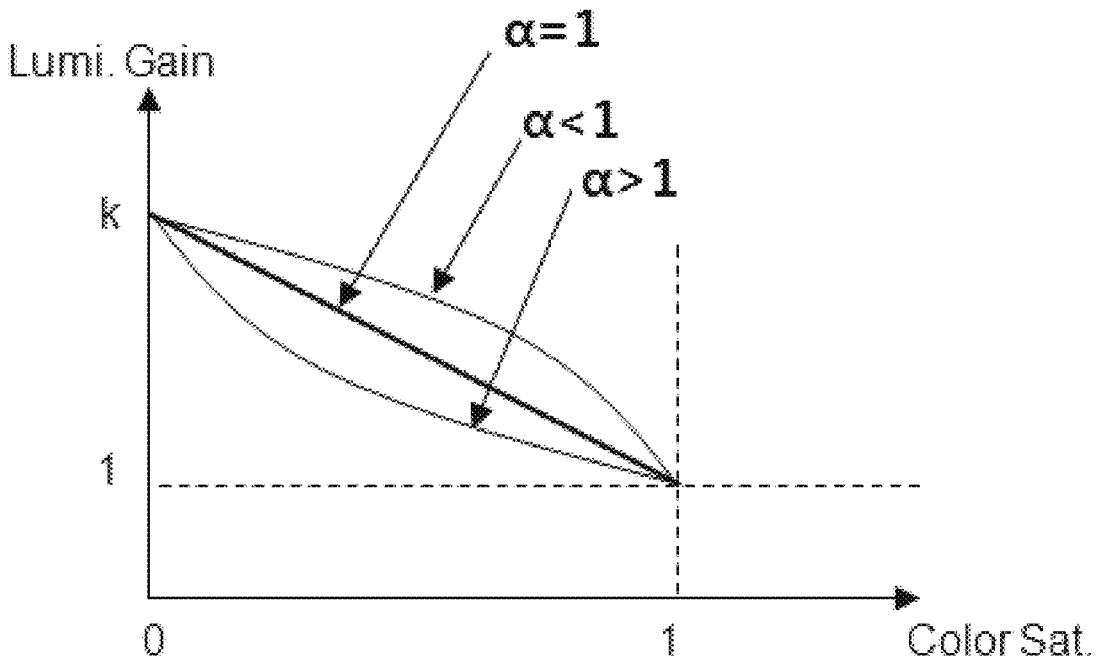

FIG. 12 is a flowchart illustrating an operation method of an image display apparatus according to an embodiment of the present invention, and FIGS. 13A and 13B are diagrams for explanation of operations illustrated in FIG. 12.

An operation method of an image display apparatus illustrated in FIG. 12 may apply to the case where a display module includes an organic light emitting panel. First, referring to FIG. 12, the controller 170 or the timing controller 232 receives RGB data of an input image (S1210).

The RGB data may be pixel data corresponding to an RGB subpixel structure. Next, the controller 170 or the timing controller 232 may perform white balancing with respect to RGB data of the input image (S1215). After the white balancing is performed, the RGB data may be converted into data ($R_i$,$G_i$,$B_i$).

Next, the controller 170 or the timing controller 232 may convert the data ($R_i$,$G_i$,$B_i$) into tristimulus data ($X_i$,$Y_i$,$Z_i$) (S1220).

Next, the controller 170 or the timing controller 232 may determine color saturation of an image signal based on the data ($R_i$,$G_i$,$B_i$) or the tristimulus data ($X_i$,$Y_i$,$Z_i$) (S1223).

For example, when color saturation of the data ($R_i$,$G_i$,$B_i$) or a color saturation of the data of the tristimulus data ($X_i$,$Y_i$,$Z_i$) is equal to or lower than a color saturation threshold, the controller 170 proceeds to step 1225 (S1225). When the color saturation of the data ($R_i$,$G_i$,$B_i$) or the color saturation of the data of the tristimulus data ($X_i$,$Y_i$,$Z_i$) is higher than the color saturation threshold, the controller 170 proceeds to step 1241 (S1241).

That is, when color saturation of an area in an input image is equal to or lower than a first color saturation threshold sat, the controller 170 or the timing controller 232 may perform the step 1225 (S1225). When color saturation of an area in an input image is higher than the first color saturation threshold sat, the controller 170 or the timing controller 232 may perform the step 1241 (S1241).

In the step 1225 (S1225), when the data ($R_i$,$G_i$,$B_i$) has luminance equal to or lower than luminance of a black pattern, a variable gamut mode or a variable color gamut mode operates.

That is, when input image data is black or approximately black, the controller 170 or the timing controller 232 does not perform a subpixel rendering operation but perform control to operate in the variable gamut mode or the variable color gamut mode. For example, in the case where an input image is a grill pattern image including a black area, as shown in FIG. 9C, the controller 170 or the timing controller 232 may display the grill pattern image based on a variable color gamut.

In the step 1225 (S1225), in the case where the data ($R_i$,$G_i$,$B_i$) have luminance higher than luminance of the black pattern, the controller 170 or the timing controller 232 may convert the data ($X_i$,$Y_i$,$Z_i$) into data ($X_L$,$Y_L$,$Z_L$) (S1226) and convert the data ($X_L$,$Y_L$,$Z_L$) into data ($R_L$,$G_L$,$B_L$) (S1227). The data ($R_L$,$G_L$,$B_L$) may be pixel data corresponding to luminance pixels.

That is, in the case where color saturation of an area in an input image is equal to or lower than a first color-saturation threshold, the controller 170 or the timing controller 232 may convert data of the input image so as to output only the luminance pixel data ($R_L$,$G_L$,$B_L$). Accordingly, a high luminance image may be displayed.

The controller 170 or the timing controller 232 may determine if (i,j) or sum of (i,j) indicative of the X coordinate and the Y coordinate of a pixel is an even number (S1229). If so, the controller 170 or the timing controller 232 may transfer at least part of the luminance pixel data ($R_L$,$G_L$,$B_L$) to an adjacent luminance pixel pixelL. Accordingly, a subpixel rendering operation is possible.

In the step 1229 (S1229), when (i,j) or sum of (i,j) indicative of the X coordinate and the Y coordinate of a pixel is an odd number, the controller 170 or the timing controller 232 may store the luminance pixel data ($R_L$,$G_L$,$B_L$) at (S1231), and calculate an APL of luminance pixel data based on the stored luminance pixel data ($R_L$,$G_L$,$B_L$) (S1233).

That is, the controller 170 or the timing controller 232 may calculate an APL of ($R_L$,$G_L$,$B_L$).

Based on the calculated APL of luminance pixel data, the controller 170 or the timing controller 232 may apply a luminance gain (S1250).

For example, the controller 170 or the timing controller 232 may perform control such that, as an APL of pixel data, that is, an APL of ($R_L$,$G_L$,$B_L$), increases, a luminance gain decreases. Accordingly, a self-emitting panel is able to be driven based on an APL, and therefore, a high luminance and high color-saturation image may be displayed while a driving operation with low power consumption is performed.

The controller 170 or the timing controller 232 may set a luminance variable gain for luminance pixel data and a luminance variable gain for color pixel data to be different. Accordingly, a high luminance image may be displayed.

Returning to step 1223, (S1223), the controller 170 or the timing controller 232 may perform step 1241 (S1241) when color saturation of an area in the input image is higher than the first color-saturation threshold sat.

Accordingly, the controller 170 or the timing controller 232 may extract achromatic data ($R_a$,$G_a$,$B_a$) from the RGB data of the input image (S1241), and convert the achromatic data ($R_a$,$G_a$,$B_a$) into data ($R_L$,$G_L$,$B_L$) (S1243). The data ($R_L$,$G_L$,$B_L$) may be luminance pixel data corresponding to luminance pixels.

The controller 170 or the timing controller 232 may calculate color saturation data ($R_C$,$B_C$,$C_C$) using data other than the achromatic data ($R_a$,$G_a$,$B_a$) in the RGB data of the input image (S1245).

That is, when color saturation of an area in the input image is higher than the first color-saturation threshold, the controller 170 or the timing controller 232 may convert data of the input image, thereby outputting the luminance pixel data ($R_L$,$G_L$,$B_L$) and the color pixel data ($R_C$,$B_C$,$C_C$). Accordingly, a high luminance and high color-saturation image may be displayed.

Then, the controller 170 or the timing controller 232 may determine if (i,j) or sum of (i,j) indicative of the X coordinate and the Y coordinate of a pixel is an even number (S1247). If so, the controller 170 may transfer at least part of the luminance pixel data ($R_L$,$G_L$,$B_L$) to an adjacent luminance pixel pixelL (S1248). Accordingly, a subpixel rendering operation is possible.

Then, the controller 170 or the timing controller 232 may calculate summed color pixel data ($R_C$,$G_C$,$B_C$) (S1249).

In the step 1247 (S1247), when (i,j) or sum of (i,j) indicative of the X coordinate and the Y coordinate of a pixel is an odd number, the controller 170 or the timing controller 232 may transfer at least part of the color pixel data ($R_C$,$G_C$,$B_C$) to an adjacent color pixel pixelC (s1251). Accordingly, a subpixel rendering operation is possible.

Then, the controller 170 or the timing controller 232 calculates summed luminance pixel data ($R_L$,$G_L$,$B_L$) (S1253), and convert an excessive portion of the luminance pixel data ($R_L$,$G_L$,$B_L$) into color pixel data ($R_C$,$G_C$,$B_C$) (S1257).

Then, the controller 170 or the timing controller 232 may apply a luminance gain based on an average luminance level or color saturation of the calculated luminance pixel data (S1250).

For example, the controller 170 or the controller 232 may perform control such that as color saturation of input image data increases, a luminance gain increases. Accordingly, a high luminance and high color-saturation image may be displayed.

FIG. 13A is a diagram illustrating a tristimulus value of each pixel.

Referring to the drawing, suppose that a gamut or color gamut of BT.709 is given when the display module 180 sums a color pixel pixelC with high color saturation and a luminance pixel pixelL with high luminance, a conversion relationship between RGB data and color pixel data and a conversion relationship between the RGB data and luminance pixel data may be exemplarily illustrated in the drawing.

FIG. 13B is a diagram illustrating a relationship between color saturation and a luminance gain according to a color saturation gain.

Referring to the drawing, as color saturation is lower, that is, as a color appears more like an achromatic color, a luminance gain is higher.

Meanwhile, an example is illustrated in which color saturation and a luminance gain are changed according to a value of a which is a color saturation gamma gain.

Specifically, when a value of the color saturation gamma gain $\alpha$ is 1, the color saturation and the luminance gain are linearly associated with each other. When a value of $\alpha$ is higher than 1, a concave non-linear curve is given in which the luminance gain is smaller compared to the color saturation. When a value of $\alpha$ is lower than 1, a convex non-linear curve is given in which the luminance gain is greater compared to the color saturation.

Figure 14:
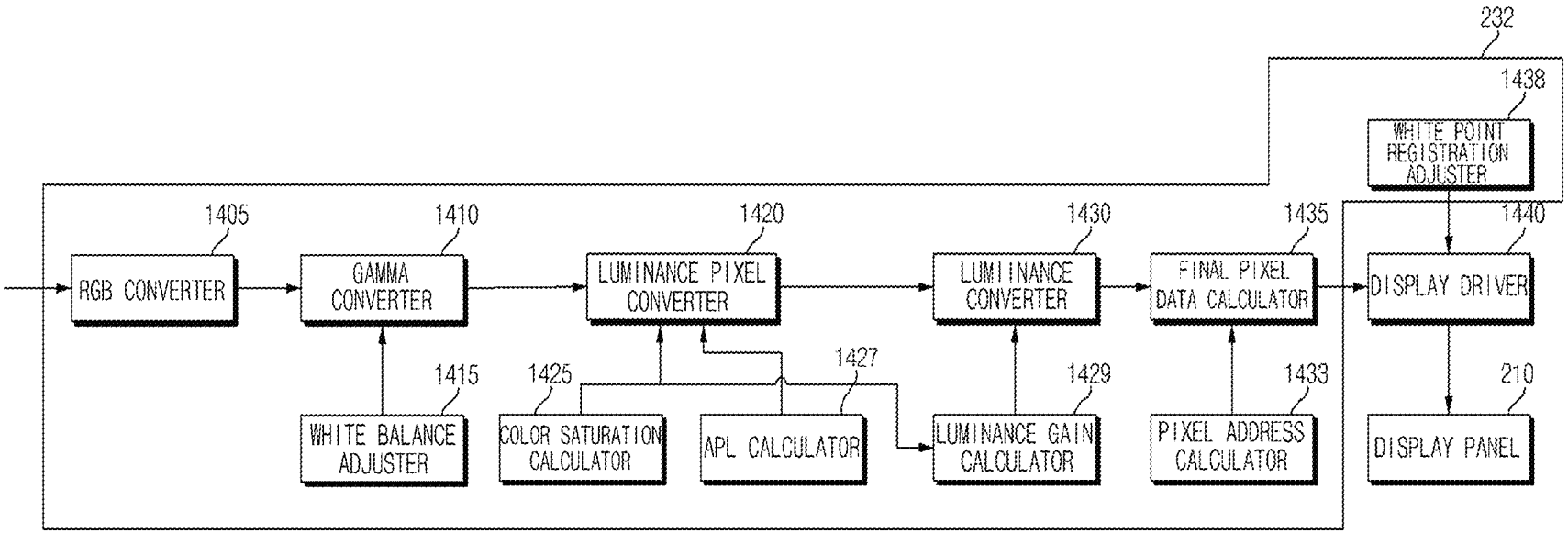
FIG. 14 is an example of an internal block diagram of a timing controller according to an embodiment of the present invention.

FIG. 14 is an example of a block diagram of a timing controller according to an embodiment of the present invention.

Referring to FIG. 14, the timing controller 232 according to an embodiment of the present invention may include an RGB converter 1405, an inverse gamma converter 1410, a white balance adjuster 1415, a luminance pixel converter 1420, a color saturation calculator 1425, an APL calculator 1427, a luminance gain calculator 1429, a luminance converter 1430, a pixel address calculator 1433, a final pixel data calculator 1435, and a white point registration adjuster 1438.

When input image data is YCbCr data, the RGB converter 1405 may convert the input YCbCr data into RGB data.

Then, the white balance adjuster 1415 performs white balancing with respect to the input image data.

In particular, the white balance adjuster 1415 may adjust white balance of a signal so as to fit a color temperature target intended according to an image mode.

Then, the gamma converter 1410 may perform inverse gamma conversion based on the white balancing and the RGB data. Accordingly, the gamma converter 1410 may output data $(R_i,G_i,B_i)$.

Then, the luminance pixel converter 1420 may convert the received data $(R_i,G_i,B_i)$ into luminance pixel data $(R_L,G_L,B_L)$.

Meanwhile, the color saturation calculator 1425 may calculate color saturation of the input image data.

When the calculated color saturation is equal to or lower than a color saturation threshold, the luminance pixel converter 1420 may convert the received data $(R_i,G_i,B_i)$ into luminance pixel data $(R_L,G_L,B_L)$.

For example, when color saturation of an area in an input image is equal to or lower than a first color saturation threshold sat, the luminance pixel converter 1420 may convert the received data $(R_i,G_i,B_i)$ into luminance pixel data $(R_L,G_L,B_L)$.

Meanwhile, the APL calculator 1427 may calculate an APL of luminance pixel data.

Then, the luminance gain calculator 1429 may calculate a luminance gain of luminance pixel data based on the calculated APL.

Then, the luminance converter 1430 may convert luminance for the luminance pixel data received from the luminance pixel converter 1420. At this point, the luminance converter 1430 may convert the luminance for the luminance pixel data based on the luminance gain received from the luminance gain calculator 1429.

For example, the luminance converter 1430 may perform luminance conversion on the basis of the fact that as an APL of pixel data, that is, an APL of $(R_L,G_L,B_L)$, increases, a luminance gain decreases. Accordingly, a self-emitting panel is able to be driven based on an APL, and therefore, a high luminance and high color-saturation image may be displayed while a driving operation with low power consumption is performed.

Then, the pixel address calculator 1433 may calculate a pixel address. For example, the pixel address calculator 1433 may perform calculation to determine if (i,j) or sum of (i,j) indicative of the X coordinate and the Y coordinate of a pixel is an even number or an odd number.

Then, when (i,j) or sum of (i,j) indicative of the X coordinate and the Y coordinate of the pixel is an even number (S1229), the final luminance converter 1435 may transfer at least part of the luminance pixel data $(R_L,G_L,B_L)$ to an adjacent luminance pixel pixelL. Accordingly, a subpixel rendering operation is possible.

Meanwhile, when (i,j) or sum of (i,j) indicative of the X coordinate and the Y coordinate of the pixel is an odd number (S1247), the final luminance converter 1435 may transfer at least part of color pixel data (RC,GC,BC) to an adjacent color pixel pixelC. Accordingly, a subpixel rendering operation is possible.

Meanwhile, the final luminance converter 1435 may calculate summed luminance pixel data $(R_L,G_L,B_L)$ (S1253), and convert an excessive portion of the luminance pixel data $(R_L,G_L,B_L)$ into color pixel data $(R_C,G_C,B_C)$. That is, the final luminance converter 1435 may calculate the luminance pixel data $(R_L,G_L,B_L)$ and the color pixel data $(R_C,G_C,B_C)$.

Then, the white point registration adjuster 1438 cause a white point of the luminance pixel L and a white point of the color pixel C to match each other.

Meanwhile, according to the subpixel rendering operation, the controller 170 or the timing controller 232 may perform control such that part of color pixel data out of entire pixel data is displayed in an adjacent luminance pixel pixelL and part of luminance pixel data out of the entire pixel data is displayed in an adjacent color pixel pixelC. Accordingly, a high luminance and high color-saturation image may be displayed.

Meanwhile, in the case where an input image is a grill pattern image including black lines, the controller 170 or the timing controller 232 may display the grill pattern image without performing subpixel rendering to transfer luminance data to a color pixel pixelC or a luminance pixel pixelL adjacent to the black area.

Figure 15:
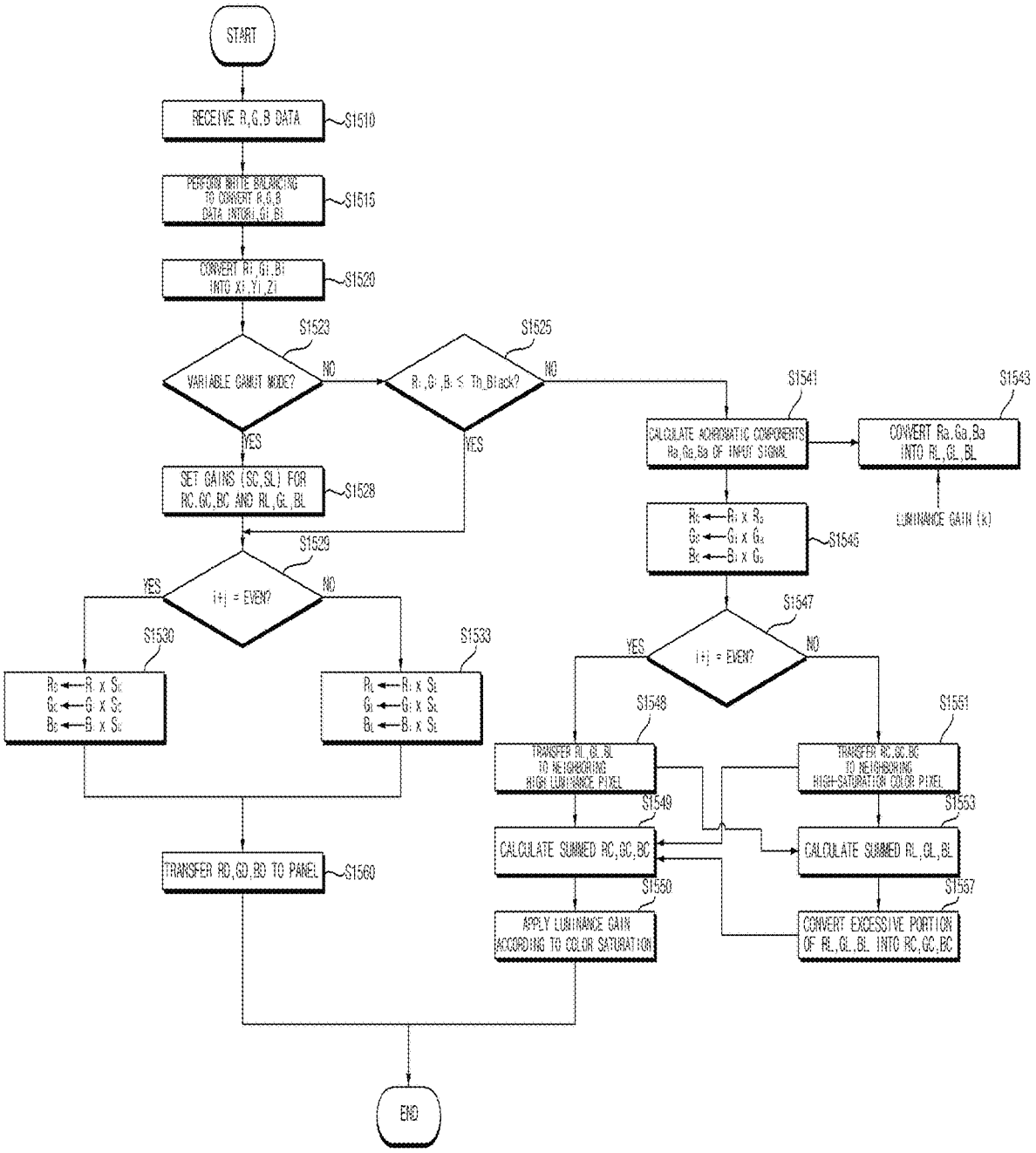
FIG. 15 is a flowchart illustrating an operation method of an image display apparatus according to another embodiment of the present invention.

FIG. 15 is a flowchart illustrating an operation method of an image display apparatus according to another embodiment of the present invention, and FIGS. 16 to 22B are diagrams for explanation of operations illustrated in FIG. 15.

The operation method of an image display apparatus in FIG. 15 may apply to the case where the display module 180 includes a liquid crystal display panel.

First, referring to FIG. 15, the controller 170 or the timing controller 232 receive RGB data of an input image (S1510).

The RGB data may be pixel data corresponding to an RGB subpixel structure.

Then, the controller 170 or the timing controller 232 may perform white balancing with respect to the RGB data of the input image (S1515). After the white balancing is performed, the RGB data may be converted into data ($R_i$,$G_i$,$B_i$).

Then, the controller 170 or the timing controller 232 may convert the data ($R_i$,$G_i$,$B_i$) into tristimulus data ($X_i$,$Y_i$,$Z_i$) (S1520).

Then, the controller 170 or the timing controller 232 may determine if a variable gamut mode is in execution, based on the data ($R_i$,$G_i$,$B_i$) or the tristimulus data ($X_i$,$Y_i$,$Z_i$) (S1523).

When it is determined the variable gamut mode is in execution, the controller 170 and the timing controller 232 perform control to proceed to step 1528 (S1528).

When it is not determined that the variable gamut mode is being implemented, the controller 170 or the timing controller 232 determines if the data ($R_i$,$G_i$,$B_i$) or the tristimulus data ($X_i$,$Y_i$,$Z_i$) are equal to or lower than luminance of a black pattern (S1525). If so, the controller 170 or the timing controller 232 performs control to proceed to step 1528 (S1528).

That is, when input image data is black or approximately black, the controller 170 or the timing controller 232 performs control to proceed to the step 1528 (S1528).

In the step 1528 (S1528), the controller 170 or the timing controller 232 may set a gain SC and a gain SL for luminance pixel data ($R_L$,$G_L$,$B_L$) and color pixel data ($R_C$,$G_C$,$B_C$), respectively, (S1528).

Then, the controller 170 or the timing controller 232 may determine if (i,j) or sum of (i,j) indicative of the X coordinate and the Y coordinate of a pixel is an even number (S1529). If so, the controller 170 or the timing controller 232 may calculate color-resolution data ($R_C$,$B_C$,$C_C$) based on the data ($R_i$,$G_i$,$B_i$) and the set color-saturation gain SC (S1530).

When (i,j) or sum of (i,j) indicative of the X coordinate and the Y coordinate of the pixel is an odd number, the controller 170 or the timing controller 232 calculates luminance pixel data ($R_L$,$G_L$,$B_L$) based on the data ($R_i$,$G_i$,$B_i$) and the set luminance gain SL (S1533).

Then, the controller 170 or the timing controller 232 may transmit pixel data ($R_D$,$G_D$,$B_D$) for a display purpose, including the calculated color pixel data ($R_C$,$B_C$,$C_C$) and the calculated luminance pixel data ($R_L$,$G_L$,$B_L$), to the display module 180 (S1560). In the step 1525 (S1525), the data ($R_i$,$G_i$,$B_i$) or the tristimulus data ($X_i$,$Y_i$,$Z_i$) has luminance higher than luminance of a black pattern, the controller 170 or the timing controller 232 may perform control to proceed to step 1541 (S1541). That is, a fixed gamut mode may be implemented.

That is, in the step 1525 (S1525), when color saturation of an area in the input image is higher than a first color-saturation threshold sat, the controller 170 or the timing controller 232 may perform control to proceed to the step 1541 (S1541).

Accordingly, the controller 170 or the timing controller 232 may extract achromatic data ($R_a$,$G_a$,$B_a$) from RGB data of the input image (S1541), and convert the achromatic data ($R_a$,$G_a$,$B_a$) into data ($R_L$,$G_L$,$B_L$) (S1543). The data ($R_L$,$G_L$,$B_L$) may be luminance pixel data corresponding to a luminance pixel.

The controller 170 or the timing controller 232 calculate color pixel data ($R_C$,$B_C$,$C_C$) using data other than the achromatic data ($R_a$,$G_a$,$B_a$) in the RGB data of the input image (S1545).

That is, when color saturation of an area in the input image is higher than the first color saturation threshold, the controller 170 or the timing controller 232 may convert data of the input image, thereby outputting the luminance pixel data ($R_L$,$G_L$,$B_L$) and the color pixel data ($R_C$,$B_C$,$C_C$). Accordingly, a high luminance and high color-saturation image may be displayed.

Then, the controller 170 or the timing controller 232 may determine if (i,j) or sum of (i,j) indicative of the X coordinate and the Y coordinate of a pixel is an even number (S1547). If so, the controller 170 or the timing controller 232 may transfer at least part of the luminance pixel data ($R_L$,$G_L$,$B_L$) to an adjacent luminance pixel pixelL (S1548). Accordingly, subpixel rendering is possible.

Then, the controller 170 or the timing controller 232 may calculate summed color pixel data ($R_C$,$G_C$,$B_C$) (S1549).

When (i,j) or sum of (i,j) indicative of the X coordinate and the Y coordinate of a pixel is an odd number (S1547), the controller 170 or the timing controller 232 may transfer at least part of the color pixel data ($R_C$,$G_C$,$B_C$) to an adjacent color pixel pixelC (S1551). Accordingly, subpixel rendering is possible.

Then, the controller 170 or the timing controller 232 calculates summed luminance pixel data ($R_L$,$G_L$,$B_L$) (S1553), and converts an excessive portion of the luminance pixel data ($R_L$,$G_L$,$B_L$) into color pixel data ($R_C$,$G_C$,$B_C$) (S1557).

Then, the controller 170 may apply a luminance gain based on an APL or color saturation of the calculated luminance pixel data (S1550).

For example, the controller 170 or the timing controller 232 may perform control such that as color saturation of input image data increases, a luminance gain increases. Accordingly, a high luminance and high color-saturation image may be displayed.

Figure 16:
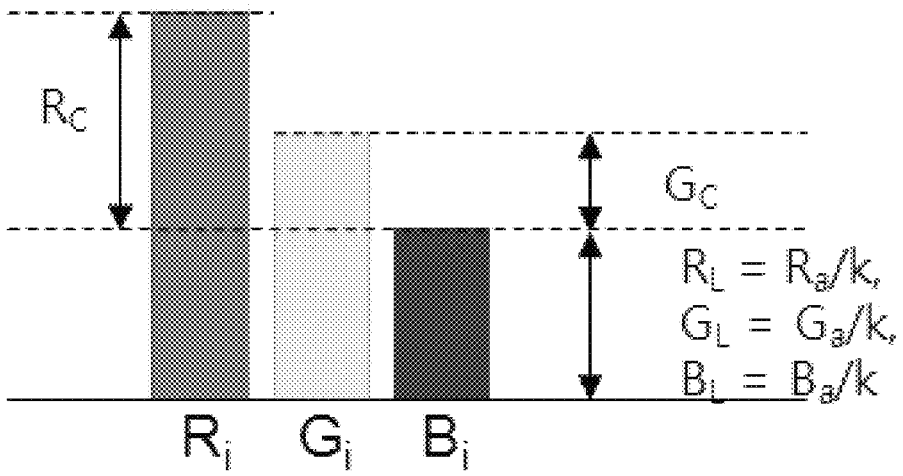
FIGS. 16 to 22B are diagrams for explanation of operations illustrated in FIG. 15.

FIG. 16 is a diagram for explanation of calculation of color pixel data and luminance pixel data when an image signal is not a pure color but a mixed color.

Referring to FIG. 16, when the image signal is not a pure color but a mixed color, the controller 170 or the timing controller 232 may calculate color pixel data and luminance pixel data.

The drawing illustrates an example in which, since values of achromatic components are identical ($R_a$=$G_a$=$B_a$=min ($R_i$,$G_i$,$B_i$) when the image signal is not a pure color but a mixed color, each of the values of the achromatic components is divided by a luminance gain k so as to obtain luminance pixel data ($R_L$,$G_L$,$B_L$).

Meanwhile, components other than the achromatic components in the image signal are pure color components, and thus, the pure color components may be calculated into color pixel data ($R_C$,$G_C$). In this case, blue pixel data does not exist in the color pixel data, as illustrated in the drawing.

If processing is done as shown in FIG. 16, $R_L$, $G_L$, $B_L$ values in luminance pixel data ($R_L$,$G_L$,$B_L$) always have identical values. This presumes that a white point of a color gamut CRL of a luminance pixel pixelL and a white point of a color gamut CRC of a color pixel pixelC are corrected to be identical.

Since luminance pixels and color pixels are alternatively arranged in the present invention, a luminance pixel and a color pixel does not exist together when image data is input at a random position. Thus, according to whether the current position corresponds to a luminance pixel or a color pixel, components of an opponent pixel may be transferred to a neighboring pixel using a subpixel rendering technique.

Figure 17:
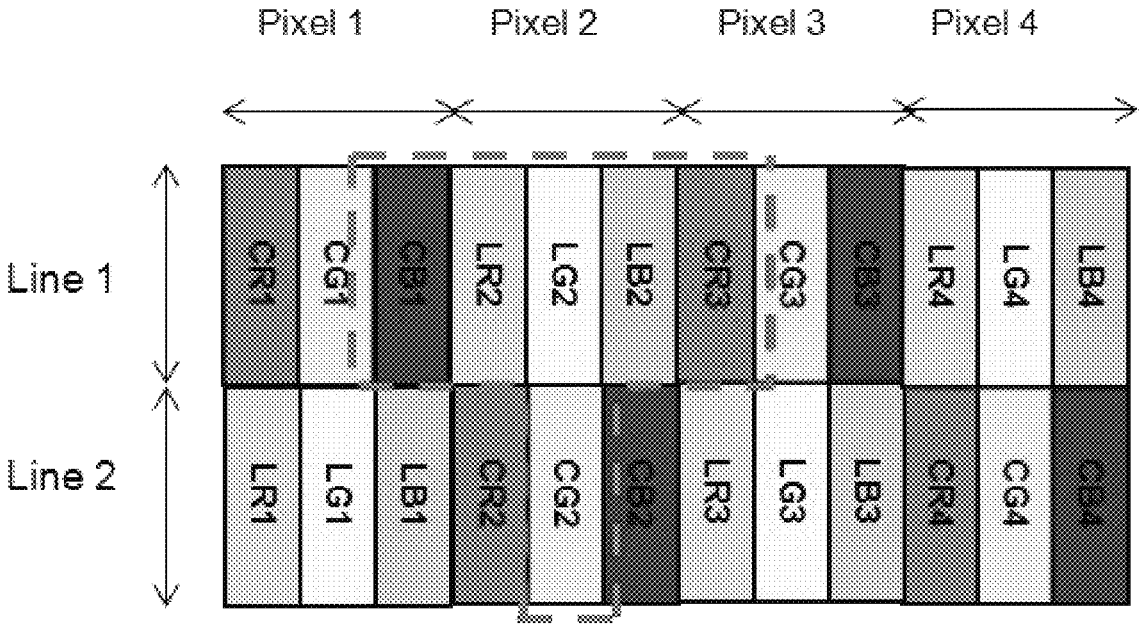

FIG. 17 is a diagram for explanation of a subpixel rendering technique.

Referring to FIG. 17, a dual primary color pixel structure of the present invention is constructed such that color pixels pixelC and luminance pixels pixelL are alternatively arranged.

In this case, if subpixels in a color pixel pixelC are referred to as CR, CG, and CB and subpixels in a luminance pixel pixelL are referred to as LR, LG, and LB, data corresponding to the six subpixels are required for an input signal.

By the subpixel rendering technique, an input image signal may be displayed using an adjacent subpixel in addition to data of six subpixels in a color pixel pixelC and a luminance pixel pixelL.

For example, with respect to Pixel 2 (LR2,LG2,LB2) which is a luminance pixel positioned on the first line in the drawing, a subpixel rendering operation may be performed using neighboring subpixels CB1 and CR3 and a subpixel CG2 positioned under Pixel 2.

In this case, instead of the subpixel CG2, both a subpixel positioned over Pixel 2 and the subpixel CG2 positioned under Pixel 2 may be used with equal priority.

Figure 18A:
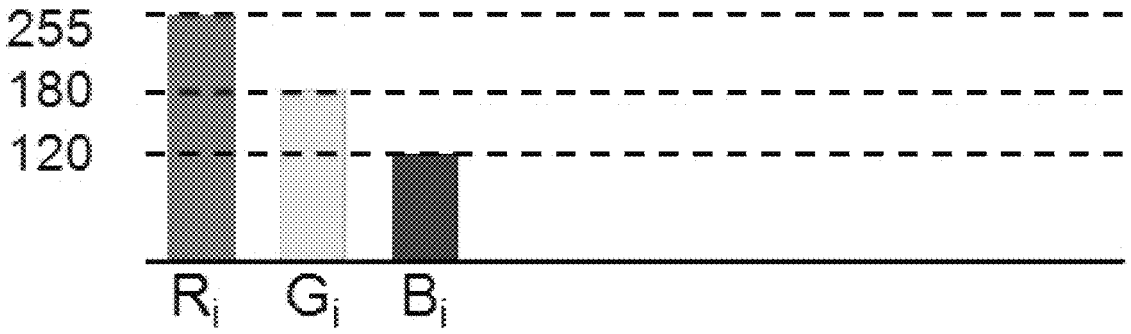
Figure 18B:
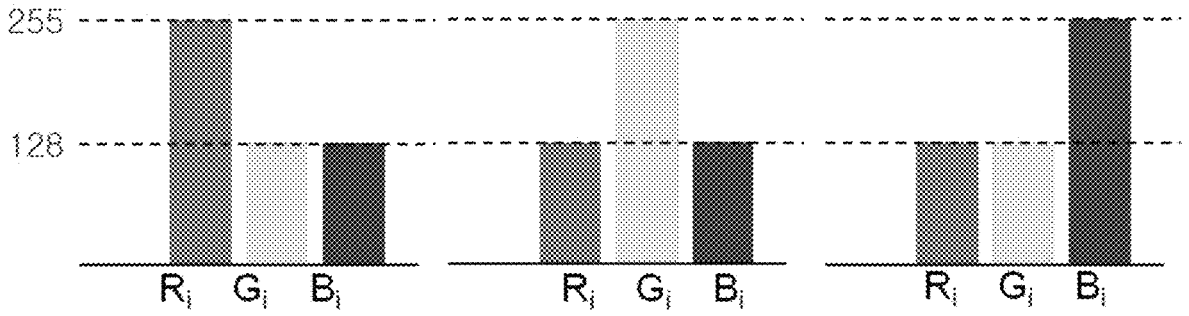

FIGS. 18A and 18B are diagrams illustrating examples in which an input image signal is converted into luminance pixel data and color pixel data.

First, FIG. 18A illustrate an example of RGB data of an input image signal.

For example, R, G, B data values of an input image may be 225, 180, and 120, respectively.

A mix level indicative of a degree of mixing of R, G, and B components may differ according to how luminance is reproduced in a stage of developing the display module 180, that is, according to design specifications.

For example, if the mix level is 100% (255 in 8 bit), subpixels LR, LG, and LB in a luminance pixel become white cells, which makes it advantageous in reproducing luminance similarly to an RGBW panel but disadvantageous in reproducing resolution and color sharpness.

Meanwhile, an example is illustrated in which, when compared with a mix level of 128 in FIG. 18B, R data and G data in the RGB data of the input image signal in FIG. 18A are higher than the mix level and B data in the RGB data is lower than the mix level. Accordingly, with respect to the input image signal as shown in FIG. 18A, according to the method described in FIGS. 12 to 17, the controller 170 or the timing controller 232 may calculate color pixel data ($R_C$, $G_C$,$B_C$) respectively corresponding to subpixels CR, CG, and CB of a color-saturation subpixel pixelC, and luminance pixel data ($R_L$,$G_L$,$B_L$) respectively corresponding to subpixels LR, LG, LB of a luminance pixel pixelL.

For example, $R_L=G_L=B_L=120/k$, $R_C=255-120=135$, and $G_C=180-120=60$.

In this case, the controller 170 or the timing controller 232 may allow $R_C$ and $G_C$ values, which are color pixel data, to be further used as luminance pixel data.

First, if values of luminance pixel data $R_L$, $G_L$, and $B_L$ are converted into equivalent values of the input image signal, this may lead to the example as shown in FIG. 18B.

That is, the input image data ($R_i$,$G_i$,$B_i$) may be (255,128, 128) with reference to $R_L$ of 255, the image input image data ($R_i$,$G_i$,$B_i$) may be (128,255,128) with reference to $G_L$ of 255, and the input image data ($R_i$,$G_i$,$B_i$) may be (128,128, 255) with reference to $B_L$ of 255.

Meanwhile, since an R data value in the input image signal shown in FIG. 18A is the greatest among R, G, and B data values, the controller 170 or the timing controller 232 first calculates $R_L$. Then, $R_C$, $G_C$, and $B_C$ are calculated using other values.

In this case, the controller 170 or the timing controller 232 may perform calculation such that $R_L=120/128*255=239$, $R_C=R_i-R_L=255-239=16$, $G_C=G_i-128*R_L/255=180-128*239/255=60$, and $B_C=B_i-128*R_L/255=120-128*239/255=0$.

Figure 19A:
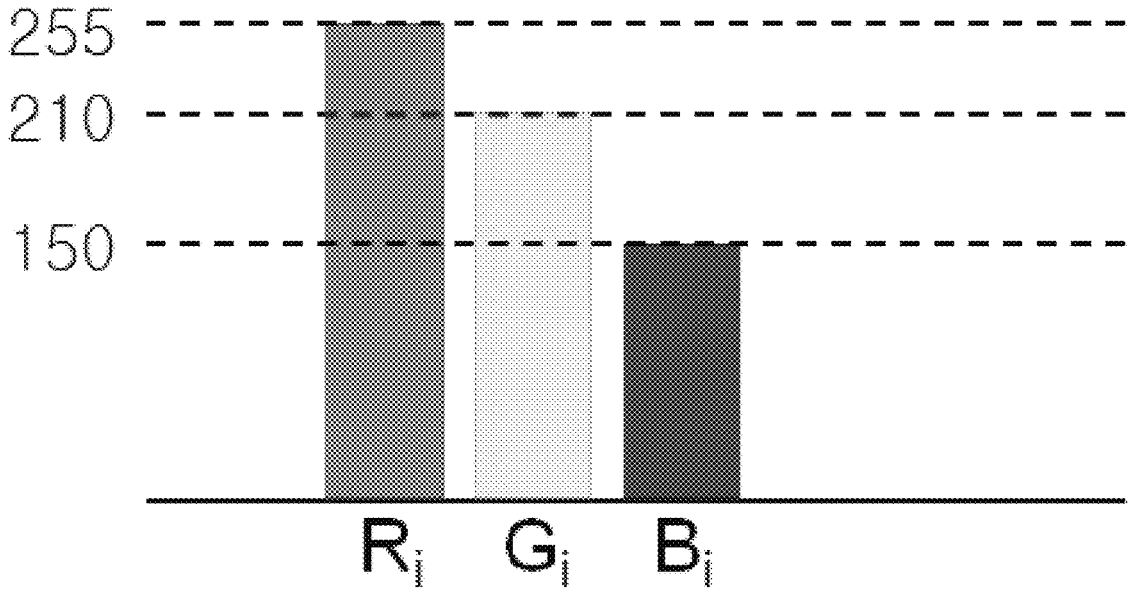
Figure 19B:
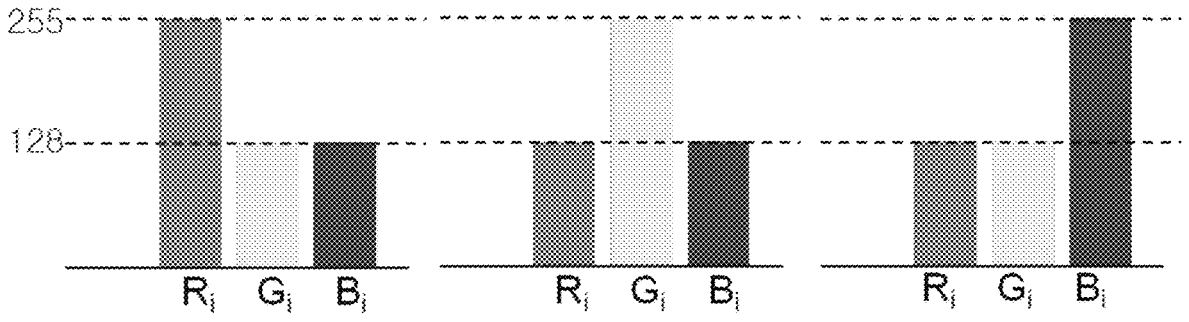

FIGS. 19A and 19B are diagrams illustrating another example in which an input image signal is converted into luminance pixel data and color pixel data.

First, FIG. 19A illustrates an example of RGB data of an input image signal.

For example, R, G, and B data values of the input image signal may be 255, 210, and 150, respectively.

Meanwhile, an example is illustrated in which, when compared with a mix level of 129 in FIG. 19B, an R data value, a G data value, and B data value in the RGB data of the input image signal in FIG. 19A are all higher than the mix level.

First, if values of luminance pixel data $R_L$, $G_L$, and $B_L$ are converted into equivalent values of the input image signal, this may lead to the example of FIG. 19B.

That is, the input image data ($R_i$,$G_i$,$B_i$) may be (255,128, 128) with reference to $R_L$ of 255, the input image data ($R_i$,$G_i$,$B_i$) may be (128,255,128) with reference to $G_L$ of 255, and the input image data ($R_i$,$G_i$,$B_i$) may be (128,128,255) with reference to $B_L$ of 255.

Meanwhile, since an R data value in the input image signal shown in FIG. 19A is the greatest among R, G, B data values, the controller 170 or the timing controller 232 first calculates $R_L$. Then, $R_C$, $G_C$, and $B_C$ are calculated using other values.

In this case, the controller 170 or the timing controller 232 may perform calculation such that $R_L=255$, $R_C=R_i-R_L=255-255=0$, $G_C=G_i-128*R_L/255=210-128*255/255=82$, and $B_C=B_i-128*R_L/255=150-128*255/255=22$.

Meanwhile, in the case of converting an input image signal into luminance pixel data and color pixel data, the input image signal is converted primarily into luminance pixel data in FIGS. 18A to 19B but the input image signal may be also converted primarily into color pixel data. This will be described with reference to FIGS. 20A and 20B.

Figure 20A:
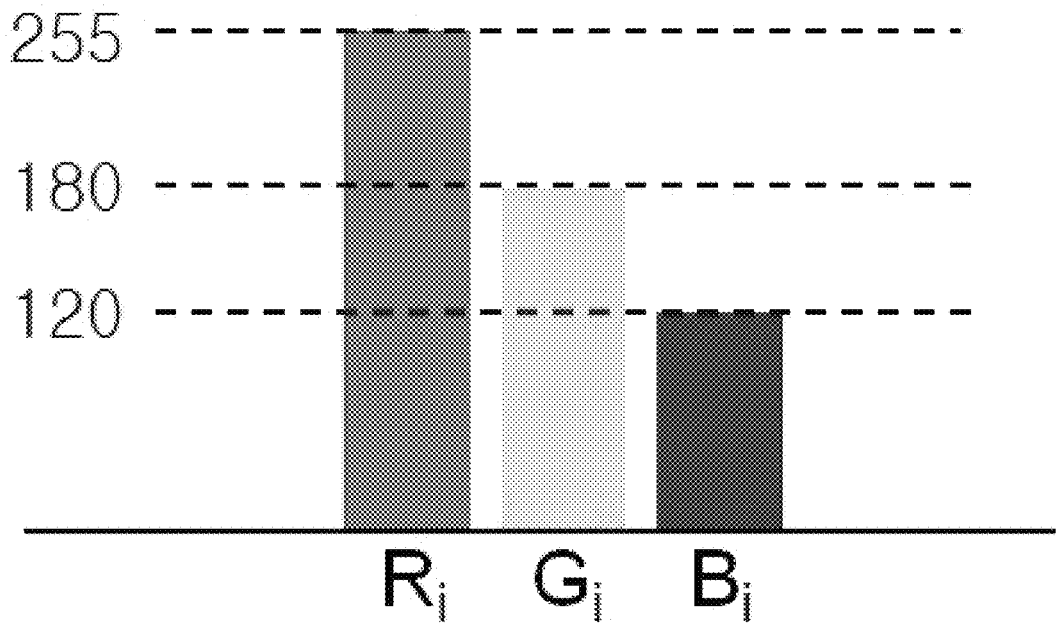
Figure 20B:
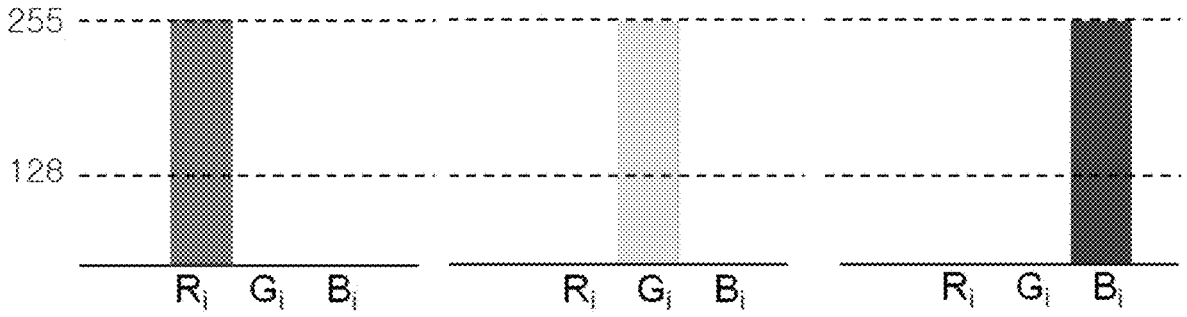

FIGS. 20A and 20B are diagrams illustrating another example in which an input image signal is converted into luminance pixel data and color pixel data.

First, FIG. 20A illustrates RGB data of an input image signal.

For example, R, G, B data values of the input image signal may be 255, 180, and 120, respectively.

A pure level indicative of a degree of purity of R, G, and B components may differ according to how chromaticity is reproduced in a stage of developing the display module 180, that is, according to design specifications.

For example, as a color gamut of the display module 180 is wider, color luminance is reduced and thus a range of luminance of pure colors reproducible tends to be narrowed.

Meanwhile, in embodiments of the present invention, a pure level is set to 128. This may imply that only a half luminance of pure colors is reproduced. In an ideal case, if the pure level is 100&(255 in 8 bit), luminance of every color may be reproduced using only CR, CG, and CB.

Meanwhile, an example is illustrated in which, when compared with a pure level of 128 in FIG. 20B, an R data value and a G data value in RGB data of the input image signal in FIG. 20A are higher than the pure level and a B data value of the input image signal is lower than the pure level.

Accordingly, in the case of the input image signal in FIG. 20A, the controller 170 or the timing controller 232 may calculate color pixel data respectively corresponding to subpixels CR, CG, and CB in a color pixel pixelC, and luminance pixel data respectively corresponding to subpixels LR, LG, and LB in a luminance pixel pixelL.

If $R_C$, $G_C$, $B_C$ values are converted into equivalent values of the input image signal, this may lead to the example of FIG. 20*b*.

That is, the input image data ($R_i$,$G_i$,$B_i$) may be (255,0,0) with reference to $R_C$ of 255. The input image data ($R_i$,$G_i$,$B_i$) may be (0,255,0) with reference to $G_C$ of 255. The input image data ($R_i$,$G_i$,$B_i$) may be (0,0,255) with reference to $B_C$ of 255.

Since an R data value in the input image signal shown in FIG. 20A is the greatest among R, G, B data values, the controller 170 or the timing controller 232 first calculates $R_C$. Then, the controller 170 or the timing controller 232 may calculate $G_C$ and $B_C$ using a value obtained by subtracting 90, which corresponds to a mid level, from remaining values except for $R_L$.

The controller 170 or the timing controller 232 may calculate $R_L$ by subtracting $R_C$ from $R_i$ in the input image data.

That is, the controller 170 or the timing controller 232 may perform calculation such that $R_C$=255−180=75, $G_C$=180−180*mid level/255=180−90=90, $B_C$=120−180*mid level/255=120−90=30, and $R_L$=$R_i$−$R_C$=255−75=180.

Accordingly, when FIGS. 18A and 18B and FIGS. 20A and 20B are compared, it is found that, if an input image signal is converted primarily into color pixel data, as shown in FIGS. 20A and 20B, a value of the color pixel data increases.

That is, according to a position of a pixel, as a value of the corresponding pixel increases, values of surrounding subpixels decrease. Accordingly, it is possible to enhance displaying accuracy in relation to the position of the pixel upon subpixel rendering.

When one or two of RGB data Ri, Gi, and Bi of an input image signal are 0, that is, pure colors, luminance pixel data $R_L$, $G_L$, $B_L$ become 0 ($R_L$=$B_L$=$B_L$=0). In this case, only half of corresponding pixels are turned on, thereby lowering luminance.

However, in the case of a UHD signal, a pure color existing on edges of a color gamut are rarely seen in a real natural system. That is, the color gamut of BT.2020, which is the color gamut of UHDTV, is a single wavelength color. Thus, this color gamut cannot be reproduced without an extremely narrow spectrum distribution like a laser Thus, as long as such an exceptional case is not considered, an image display apparatus satisfying a UHDTV standard color gamut may be achieved when using luminance pixels pixelL including subpixels LR, LG, and LB and color pixels pixelC including subpixels CR, CG, and CB.

A display panel according to another embodiment of the present invention may include luminance pixels pixelL including RGB subpixels, and color pixels pixelC including CMY subpixels. That is, each luminance pixel pixelL may be comprised of subpixels of R, G, and B colors, and each color pixel pixelC may be comprised of subpixels of C, M, and Y colors. In this case, the luminance pixel pixelL and the color pixels pixelC may be alternatively arranged in a checkerboard pattern.

In such a display panel according to another embodiment of the present invention, a color gamut CRC of color pixels pixelC, as shown in FIG. 8B, may be wider than a color gamut CRL of the luminance pixels pixelL, as shown in FIG. 8A.

When luminance pixels pixelL and color pixels pixelC are alternatively arranged in a checkerboard pattern, a high luminance image may be displayed with a wider color gamut CRL.

Following is description about how to display a grill pattern image in various subpixel structures when an input image is a grill pattern image including a black area.

FIG. 21 illustrates an example in which a grill pattern image including a black area is displayed in an RGB subpixel structure.

Figure 21A:
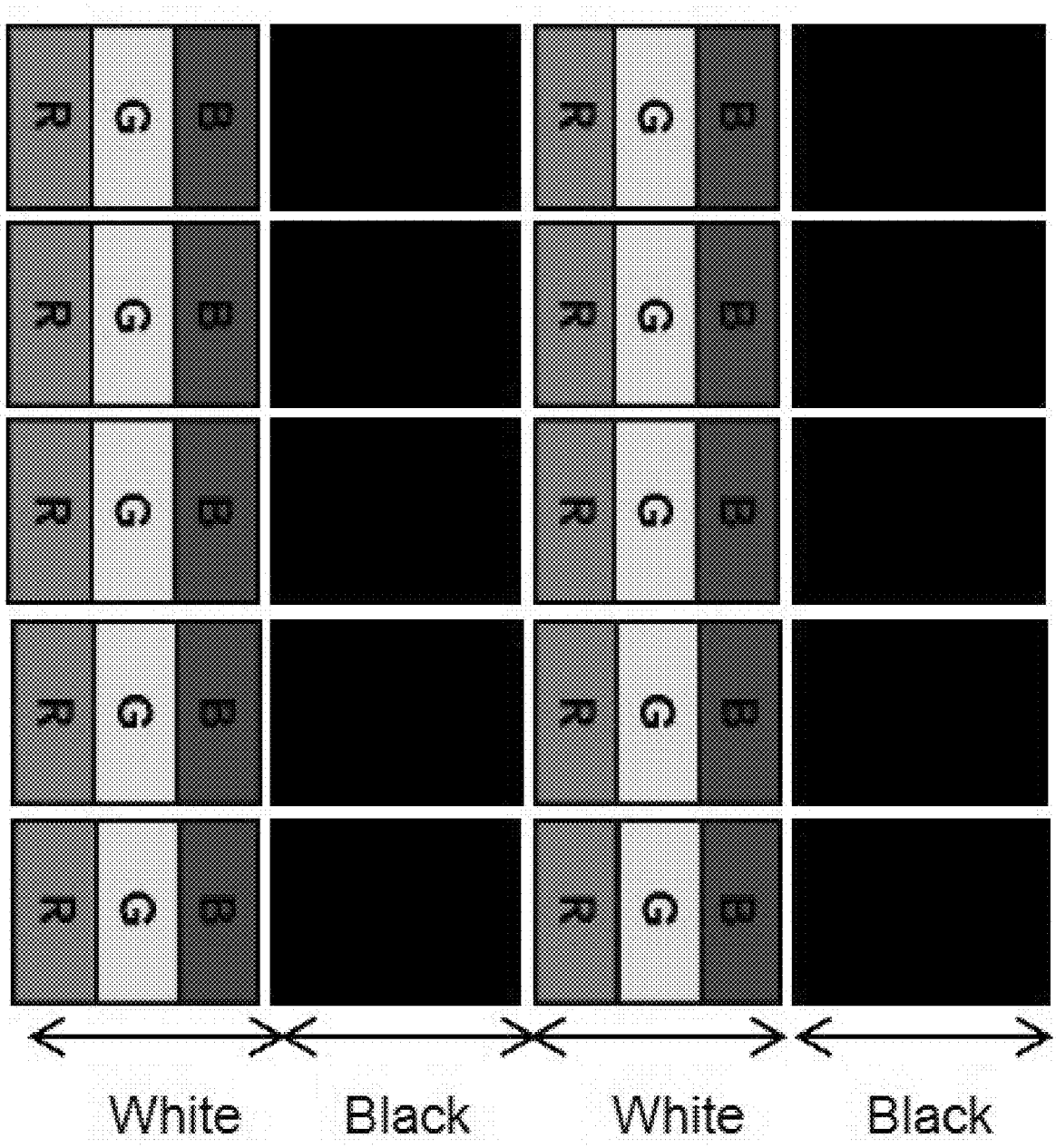

Referring to FIG. 21A, in the RGB subpixel structure, with reference to going left to right, a first RGB subpixel line emits light, a second RGB subpixel line adjacent to the first RGB subpixel is turned off, a third RGB subpixel line adjacent to the second RGB subpixel emits light, and a fourth RGB subpixel line adjacent to the third RGB subpixel is turned off.

Figure 21B:
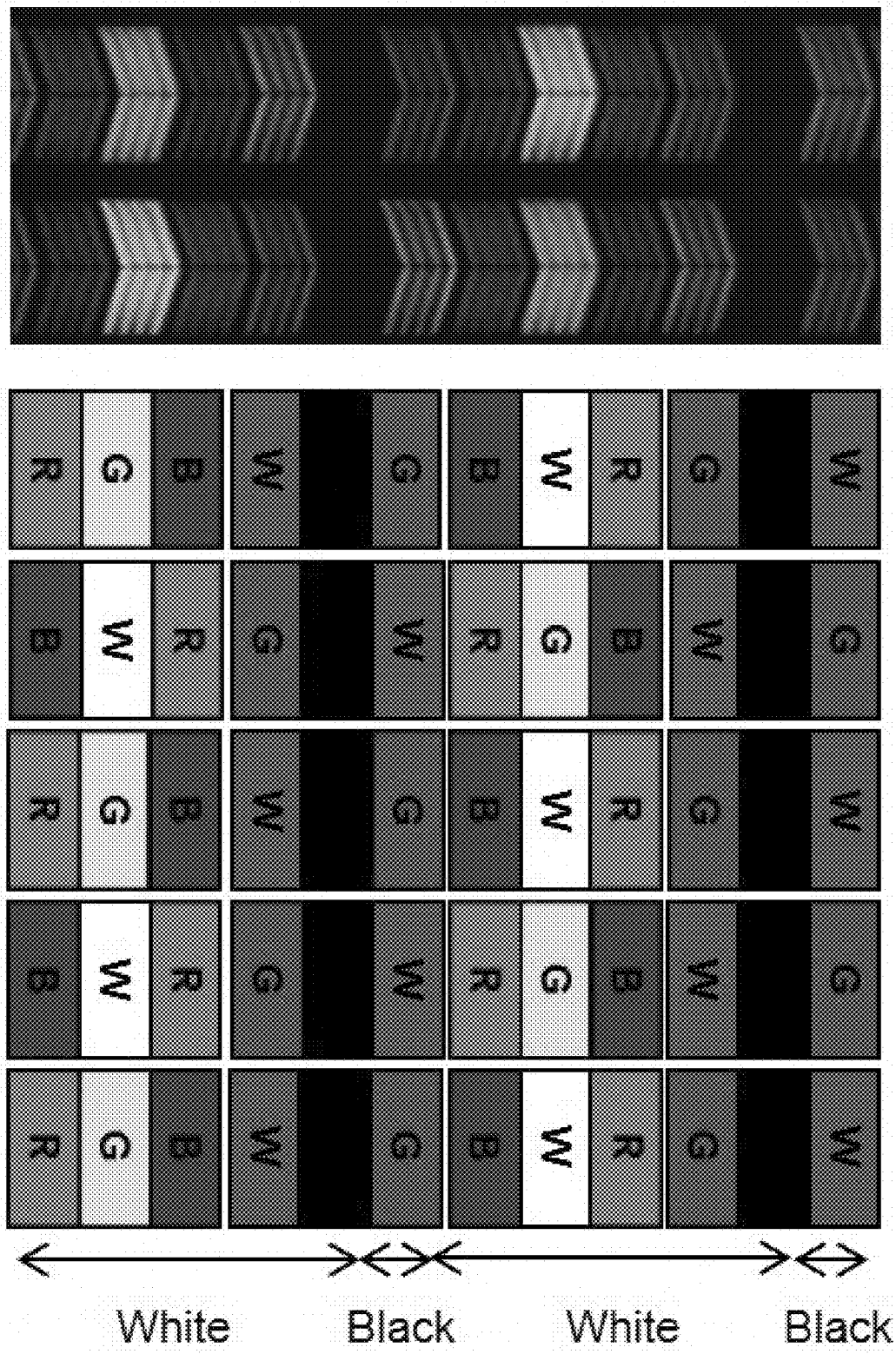

FIG. 21B illustrates an example in which a grill pattern image including a black area is displayed in a WRGB subpixel structure.

Referring to FIG. 21B, in the WRGB subpixel structure, with reference to the top left portion going left to right, RGB subpixels emit light, WRG subpixels adjacent to the RGB subpixels are turned off, BWR subpixels adjacent to the WRG subpixels emit light, and GBW subpixels adjacent to the BWR subpixels are turned off.

Meanwhile, in the WRGB subpixel structure, subpixel rendering is performed in order to display an image, and thus, there is a problem that the grill pattern image including the black area cannot be displayed with sharpness, as shown in the resulting image.

Figure 21C:
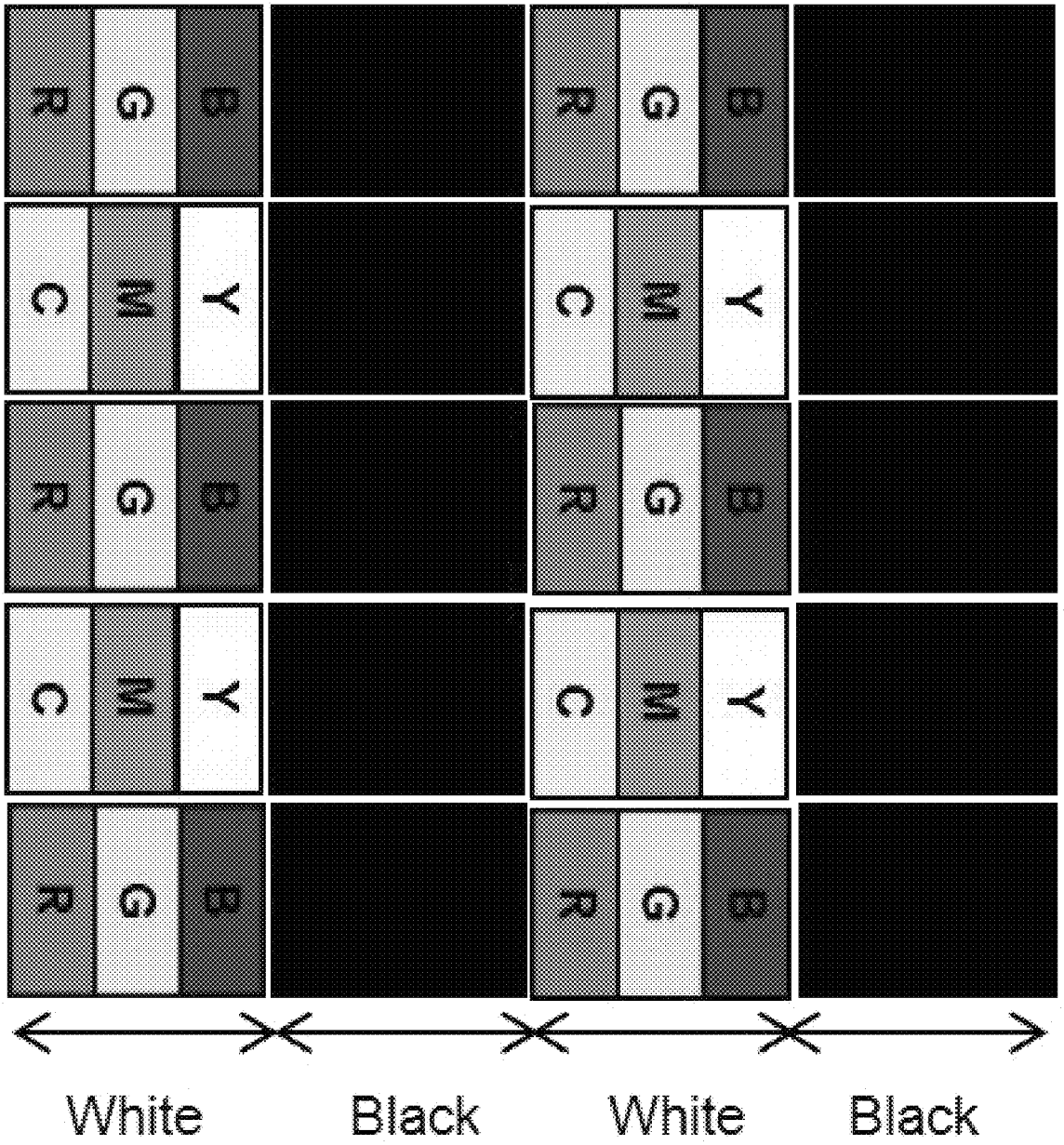

FIG. 21C illustrates an example in which a grill pattern image including a black area is displayed in a structure including luminance pixels pixelL including CMY subpixels and color pixels pixelC including RGB subpixels according to another embodiment of the present invention.

Referring to FIG. 21C, in the structure including the luminance pixel pixelL and the color pixel pixelC, with reference to the top left portion going left to right, RGB subpixels in a color pixel pixelC emits light and CMY subpixels in a luminance pixel pixelL adjacent to the corresponding color pixel pixelC is turned off.

Meanwhile, with reference to the second line from the right side, CMY subpixels in a color pixel pixelC emits light, and RGB subpixels in the luminance pixel pixelL adjacent to the corresponding color pixel pixelC are turned off.

That is, in the case of displaying a grill pattern image including a black area in the structure including the luminance pixels pixelL and the color pixels pixelC according to another embodiment of the present invention, subpixel rendering is not performed and therefore the grill pattern image including the black area is displayed with sharpness.

Figure 22A:
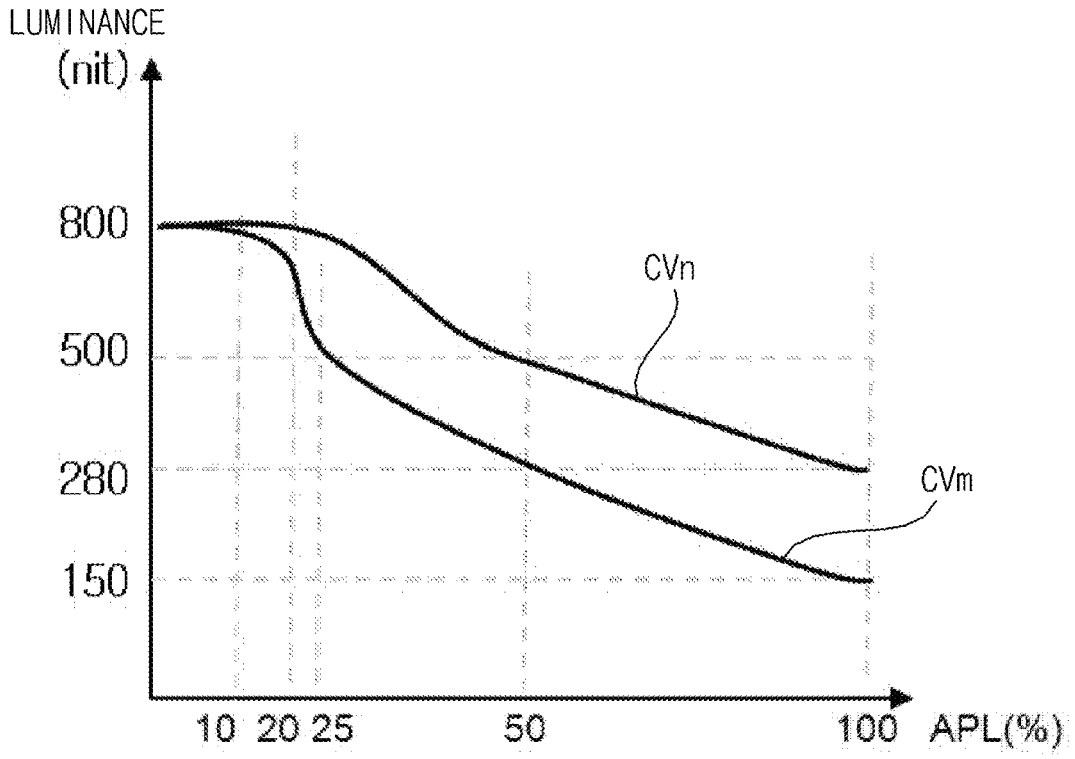

FIGS. 22A and 22B are diagrams illustrating examples of comparison in performance between a display module including WRGB subpixels and a dual primary color display module including luminance pixels pixelL and color pixels pixelC according to the present invention.

A first curve CVm in FIG. 22A is a curve indicative of luminance according to an APL in a display module including WRGB subpixels, and a second curve CVn is a curve of luminance according to an APL in a dual primary color display module including luminance pixels pixelL and color pixel pixelC.

FIG. 22A will be described with reference to FIG. 22B. If the APL is 10%, luminance is almost the same in both the display module including WRGB subpixels and the dual primary display module. However, if the APL increases to 20%, 25%, 50%, and 100%, difference in luminance between the two display modules increases.

In particular, if the APL is equal to or higher than 50%, light emission efficiency of the dual primary color display module increases to be approximately two times higher than light emission efficiency of the display module including WRG subpixels.

Accordingly, a high luminance and high color-saturation image may be displayed in the dual primary color display module including luminance pixels pixelL and color pixels pixelC. In addition, a high resolution image may be displayed in the dual primary color display module.

An operation method of the image display apparatus of embodiments of the present invention may be implemented in a recording medium, readable by a processor provided in the electronic apparatus, in the form of a code readable by the processor. The recording medium readable by the processor includes all kinds of recording devices in which data readable by the processor is stored. Examples of the recording medium readable by the processor may include a read only memory (ROM), a random access memory (RAM), a compact disk read only memory (CD-ROM), a magnetic tape, a floppy disc, and an optical data storage device. In addition, the recording medium readable by the processor may be implemented as a carrier wave (e.g., data transmission over the Internet). Furthermore, the recording medium readable by the processor may be distributed over computer systems connected over a network, and the code readable by the processor may be stored and executed in a distributed manner.

Although the exemplary embodiments have been illustrated and described, embodiments are not limited to the above-described particular embodiments, various modifications are possible by those skilled in the art without departing from the scope and spirit as disclosed in the accompanying claims and these modifications should not be understood separately from the scope and spirit.

What is claimed is:

1. An image display apparatus comprising:

a display panel comprising a plurality of pixels; and a controller configured to control the display panel, wherein the plurality of pixels comprises luminance pixels including subpixels of multiple colors and color pixels including subpixels of multiple colors, and wherein the luminance pixels output light with luminance higher than luminance of the color pixels and the color pixels output light with color purity higher than color purity of the luminance pixels, wherein the controller is configured to:

calculate luminance pixel data and color pixel data based on image data of an input image;

output only the luminance pixel data based on color saturation of an area in the input image being less than or equal to a first color saturation threshold;

output both the luminance pixel data and the color pixel data based on the color saturation of the area in the input image being higher than the first color saturation threshold;

in response to the luminance pixel and the color pixel being used together, display an achromatic area of the image data as a high luminance pixel and display any area other than the achromatic area as a high color pixel; and cause a white point of the luminance pixel and a white point of the color pixel to match each other.

2. The image display apparatus of claim 1, wherein the controller is configured to:

separate an input image into luminance pixel data for displaying the image via the luminance pixels and color pixel data for displaying the image via the color pixels; and output at least one of the luminance pixel data or the color pixel data.

3. The image display apparatus of claim 2, wherein the controller is further configured to:

change luminance of the luminance pixel data or luminance of the color pixel data to be different from luminance of the input image; and change a color gamut of the luminance pixel data or a color gamut of the color pixel data to be different from a color gamut of the input image.

4. The image display apparatus of claim 3, wherein the controller is further configured to set a luminance variable gain for the luminance pixel data and a luminance variable gain for the color pixel data to be different from each other.

5. The image display apparatus of claim 2, wherein the display panel includes an organic light emitting panel, and wherein the controller is configured to:

convert a luminance level of the input image into a set luminance level based on the calculated APL; and output at least one of the luminance pixel data or the color pixel data based on the converted luminance level.

6. The image display apparatus of claim 2, wherein the controller is further configured to output the luminance pixel data and the color pixel data at any area other than an achromatic area of the input image.

7. The image display apparatus of claim 2, wherein the luminance pixels and the color pixels are arranged in a checkerboard pattern, and wherein the controller is configured to control the display panel to display the input image comprising a stripe pattern image having a black area without performing a subpixel rendering operation of transferring luminance data to an adjacent color pixel or an adjacent luminance pixel with respect to the black area.

8. The image display apparatus of claim 2, wherein the luminance pixels and the color pixels are arranged in a checkerboard pattern, and wherein the controller is further configured to control the display panel to display the input image comprising a stripe pattern image having a black area based on a variable color gamut.

9. The image display apparatus of claim 2, wherein the display panel comprises a liquid crystal panel, and wherein the controller is further configured to perform a subpixel rendering operation with respect to the input image of transferring luminance data to an adjacent color pixel or an adjacent luminance pixel.

10. The image display apparatus of claim 9, wherein the controller is further configured to control the display panel to display a portion of color pixel data in an adjacent luminance pixel and a portion of luminance pixel data in an adjacent color pixel according to the subpixel rendering operation.

11. The image display apparatus of claim 2, wherein the controller is further configured to control the display panel to display the input image comprising a stripe pattern image having a black area without performing a subpixel rendering operation of transferring luminance data to an adjacent color pixel or an adjacent luminance pixel with respect to the black area.

12. The image display apparatus of claim 1, wherein the multiple colors of the luminance pixels and the multiple colors of the color pixels are identical.

13. The image display apparatus of claim 12, wherein the multiple colors of the luminance pixels and color pixels include subpixels of red (R), green (G), and blue (B) colors.

14. The image display apparatus of claim 1, wherein the multiple colors of the luminance pixels and the multiple colors of the color pixels are different.

15. The image display apparatus of claim 14, wherein one of the luminance pixels or the color pixels have subpixels of cyan (C), magenta (M), and yellow (Y) colors, and the other of the luminance pixels or the color pixels have subpixels of R, G, B colors.

16. The image display apparatus of claim 1, wherein the controller is further configured to change the luminance gain based on color saturation of the image data of the input image, wherein as the color saturation of the input image data increases, the luminance gain increases.

17. The image display apparatus of claim 1, wherein the controller is configured to:

calculate an Average Picture Level (APL) of the luminance pixel data based on the luminance pixel data, wherein as the APL of the luminance pixel data increases, the luminance gain decreases.

* * * * *